US005749212A

United States Patent [19]

Rees et al.

[11] Patent Number: 5,749,212

[45] Date of Patent: May 12, 1998

[54] ELASTOMERIC CORE/STAPLE FIBER WRAP YARN

[75] Inventors: John Joseph M. Rees, Signal Mountain, Tenn.; Leonard L. Hixon, Jr., Dalton, Ga.

[73] Assignee: Dixy Yarns, Inc., Chattanooga, Tenn.

[21] Appl. No.: 470,209

[22] Filed: Jun. 6, 1995

[51] Int. Cl.[6] ..... D02G 3/02; D02G 3/36

[52] U.S. Cl. ..... 57/225; 57/224; 57/230; 57/252; 57/255

[58] Field of Search ..... 57/210, 211, 224, 57/225, 226, 231, 230, 252, 255

[56] References Cited

U.S. PATENT DOCUMENTS

| | | | |
|---|---|---|---|
| 1,762,389 | 6/1930 | Fagan | 57/225 |
| 2,488,941 | 11/1949 | Schneller | 57/225 |
| 2,587,117 | 2/1952 | Clay | 57/225 |
| 2,852,834 | 9/1958 | Engelhard | 57/225 |
| 4,246,744 | 1/1981 | Matsui et al. | 57/22 |
| 4,263,775 | 4/1981 | Mima | 57/22 |
| 4,292,796 | 10/1981 | Mima | 57/22 |
| 4,299,884 | 11/1981 | Payen | 57/224 |
| 4,411,128 | 10/1983 | Mima | 57/22 |
| 4,481,761 | 11/1984 | Kimura | 57/22 |
| 4,517,794 | 5/1985 | Sakai et al. | 57/304 |
| 4,840,021 | 6/1989 | Guevel | 57/224 |
| 4,958,485 | 9/1990 | Montgomery et al. | 57/224 |
| 4,990,158 | 2/1991 | Kaplan et al. | 57/225 |
| 5,159,806 | 11/1992 | Mori et al. | 57/328 |
| 5,383,331 | 1/1995 | Proctor | 57/224 |
| 5,414,984 | 5/1995 | Groshens et al. | 57/224 |

FOREIGN PATENT DOCUMENTS

| | | | |
|---|---|---|---|
| 2477583 | 9/1981 | France | 57/225 |
| 5-186924 | 7/1993 | Japan | 57/225 |
| 5-26331 | 10/1993 | Japan | 57/224 |

OTHER PUBLICATIONS

Murata Leads the Spinning Industry Into the 21st Century, No. 802MJS Brochure. (No Date.

*Primary Examiner*—William Stryjewski
*Attorney, Agent, or Firm*—Parkhurst, Wendel & Burr, L.L.P.

[57] ABSTRACT

A jet spun twistless core/wrapped elastic yarn product. The core yarn of the core/wrapped yarn is a unitary elastomeric filament. The core yarn is contiguously provided around the core with staple fibers. The inner portion of the staple fibers extends in the same direction as the elastomeric core and an outer wrapper portion of the staple fibers is helically wound around and holds the inner portion of the staple fibers on the core.

19 Claims, 27 Drawing Sheets

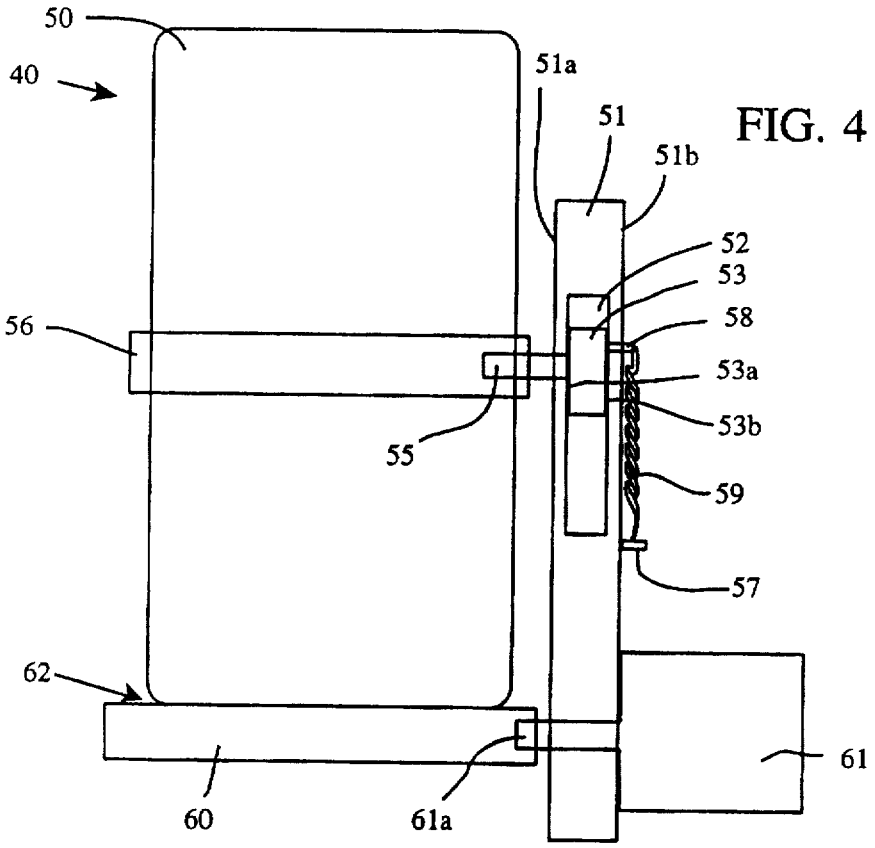
FIG. 4
FIG. 5A
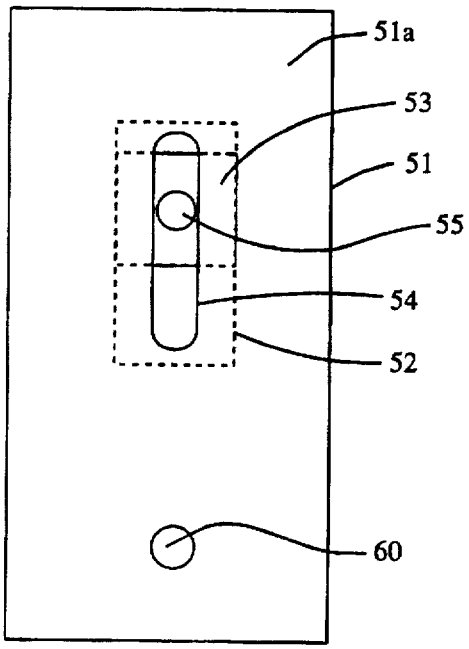
FIG. 5B
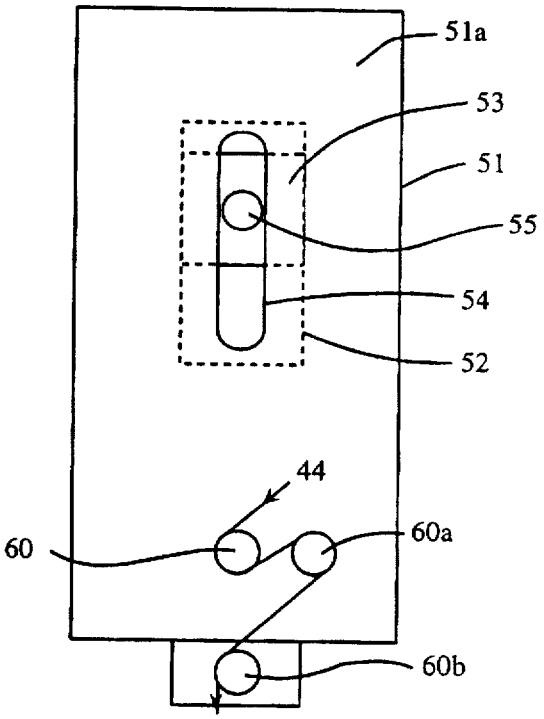

RELAY 3
P1-Z
S1-Z
324
P1-22
S1-22
P1-Y
S1-Y
301c
P1-21
S1-21
P1-14
S1-14
24V
P1-15
S1-15
P1-16
S1-16
P1-17
S1-17
P1-18
S1-18
P1-T
S1-T
256 SOLENOID
P1-U
S1-U
257 SOLENOID
P1-V
S1-V
255 SOLENOID
SPARE
P1-S
S1-S
P1-R
S1-R
41 SOLENOID
RELAY 1
P1-W
S1-W
322
P1-19
S1-19
323
RELAY 2
P1-X
S1-X
(SPARE)
P1-20
S1-20
P1-K
S1-K
SHUT-OFF
61
P1-J
S1-J
ENABLE
61
5V
R21
10K
R22

INITIAL THREAD-UP SEQUENCE

AUTOMATIC THREADING SEQUENCE

BREAKAGE SEQUENCE

SHUT-DOWN SEQUENCE

ELASTOMERIC CORE/STAPLE FIBER WRAP YARN

BACKGROUND OF THE INVENTION

The present invention relates to a system for forming elastomeric core/staple fiber wrap yarn using an air jet spinning machine. The present system all but renders obsolete all current methods for forming elastomeric core/wrap yarns.

It has been known in the textile industry to form core/wrap yarns, consisting of a single elastomeric core having a multiple staple fiber wrap wound therearound, e.g., Lycra® spandex core/cotton wrap yarn, encapsulating the core with an external sheath of fiber. Such core/wrap yarns are suitable for use in stretch apparel such as bathing suits, undergarments, hosiery, or other snugly fitting clothing items or comfortable regular fitting clothing. These core/wrap yarns have been formed by such methods as wrap spinning and sliver or roving fed ring spinning. However, these methods are very labor intensive and thus expensive, and the quality of the end product is lower than desired for high speed mass production.

In recent years, the industry has turned to air jet spinning to produce synthetic and blend yarns used extensively in the apparel industry. Currently, Murata Machinery Ltd., Kyoto, Japan, manufactures an air jet spinner sold under the trade name MJS, which can form synthetic and cotton/synthetic blend yarns. Although it has been desired to use a machine like the Murata MJS machine to form core/wrap yarns like spandex/cotton yarns, no one has ever successfully adapted a machine like the MJS machine to allow fully automated, trouble-free mass-production of such yarns.

A single spinner station or so-called spindle of the MJS system is shown schematically in FIG. 1 (reproduced from U.S. Pat. No. 4,517,794, the entire disclosure of which is incorporated herein by reference). A sliver supply container 28 is provided behind a drafting assembly 11 for supplying raw material/substrate sliver S to the spindle. The drafting assembly 11 is a three-roller drafting system including rear rollers 8, apron rollers 9 and front rollers 10. The rear rollers 8 deliver the sliver to the apron rollers 9. The apron rollers 9 are rotating faster than the rear rollers 8 to stretch, draft, orient and flatten the sliver. The front rollers 10 are rotating even faster than the apron rollers 9 to draw the sliver at a desired ratio. Additional rollers can be added between the rear rollers 8 and apron rollers 9 to provide a four- or five-roller drafting assembly.

The sliver is delivered from the front rollers 10 to an air jet nozzle 12, which, as shown conceptually in FIG. 2, includes two air jets **12*a*,12*b*, which air wrap the fibers which form the yarn in the same or opposite directions. As is known in the art, the jet spinners twist wrapper fibers from the sliver to provide a tightly wound yarn which is then taken up on a take-up roll 22 provided in take-up assembly 21,22,23. As is also known in the art, the take-up assembly includes a yarn clearer sensor 3, e.g., a Seletex™ sensor, which optically or capacitively monitors the quality of yarn exiting the air jet nozzle 12**.

The MJS includes an automatic knotter 7, which, in the event of breakage of yarn Y, will automatically grasp yarn from the exit of the air jet nozzle 12 via suction hose 24 and splice or knot that yarn with yarn already wound on the take-up roll 22. A suction pipe 25 removes yarn from the take-up roll, and the two yarns are combined by splicing or knotting mechanism 27. See U.S. Pat. No. 4,517,794 for an explanation of the remaining components shown in FIG. 1 herein.

In a typical MJS machine, which includes perhaps 60 separate side-by-side spindles, the knotter can travel up and down the machine line to service any individual spindle. In the event of yarn breakage, the microprocessor for the spindle on which the yarn breakage occurred sends a signal to the knotter, and the knotter then travels down the machine line until it contacts a microswitch located on the back of the spindle in need of servicing. Once the knotter is in position, the yarns are joined together via the splicing or knotting device 27.

Murata has several patents on the air jet nozzle and the splicing or knotting mechanism. See, for example, U.S. Pat. Nos. 5,159,806, 4,246,744, 4,263,775, 4,292,796, 4,411,128 and 4,481,761, each of which is fully incorporated herein by reference.

In the operating manual for the Murata 802MJS it is alleged that Murata has a system capable of forming core/wrap yarn having a filament (i.e., non-elastic) yarn core and a staple fiber wrap. While, that system is not actually known to the present applicants, it is believed to require manual threading in the event of yarn breakage, a condition that occurs quite frequently, or is, not reliable for automatic re-threading. A cutter cuts out bad quality yarn if a defect is detected. Accordingly, the alleged Murata filament feed system is not suitable for mass production.

SUMMARY OF THE INVENTION

It is an object of the present invention to provide a core yarn feeding system to be used with the MJS system, which facilitates efficient production of core/wrap yarns, e.g., Lycra® spandex core/cotton wrap yarns.

It is another object of the present invention to provide a system for forming elastomeric core/wrap yarn using an air jet spinning machine, comprising:

threading means for feeding elastomeric yarn to a drafting zone of an air jet spinning machine;

feed means for providing a controlled supply of elastomeric yarn to said threading means; and elastomeric yarn sensing means provided between said threading means and said feed means or as part of said threading means for detecting the presence of the elastomeric yarn passing from said feed means to said threading means;

wherein the elastomeric yarn and sliver fed through the drafting zone are combined in an air jet nozzle of the air jet spinning machine to form an elastomeric core/wrap yarn.

It is yet another object of the present invention to provide a package feed device for delivering yarn from a cylindrical creel package to a material handling device, comprising:

a vertically oriented mounting plate having a front surface and opposed rear surface, and upper and lower portions;

a drive roller extending substantially perpendicularly from said lower portion of said front surface of said mounting plate;

means for rotating said drive roller at a desired speed;

a creel package tube holder subassembly extending substantially perpendicularly from said upper portion of the front surface of said mounting plate, to carry said creel package; and means for biasing said creel package tube holder subassembly toward said drive roller to provide constant contact between the outer peripheral surface of the cylindrical creel package and said drive roller.

It is still another object of the present invention to provide a sensor for sensing the presence and motion of a moving yarn or thread, comprising:

a housing;

rotatable wheel means provided on said housing and having opposed metal side surfaces; and means for generating magnetic eddy currents through said opposed metal side surfaces to inhibit rotation of said wheel means at high rotational speeds.

It is yet another object of the present invention to provide a sensor for sensing the presence and motion of a moving yarn or thread, comprising:

a housing;

rotatable wheel means provided on said housing for rotation by a moving yarn or thread; and means for sensing the rotational speed of said wheel means.

It is still another object of the present invention to provide a drafting assembly for conveying yarn, comprising:

a main body frame;

roller means for conveying a first yarn, said roller means comprising a pair of opposed apron rollers and a pair of opposed front rollers;

clearer means for removing fibrous debris from at least one of said pair of opposed apron rollers;

front roll wrap sensor means for sensing a yarn wrap condition on at least one of said pair of opposed front rollers; and threading means for introducing a second yarn to said front rollers.

The present invention will be explained in more detail below with reference to the following drawings.

BRIEF DESCRIPTION OF THE DRAWINGS

FIG. 4 is a partial cross-sectional view of the package drive assembly of the present invention;

FIG. 5A is a front view of the package drive assembly with the creel package removed;

FIG. 5B is a front view of a modified package drive assembly with the creel package removed;

DETAILED DESCRIPTION OF THE INVENTION

Figure 1:
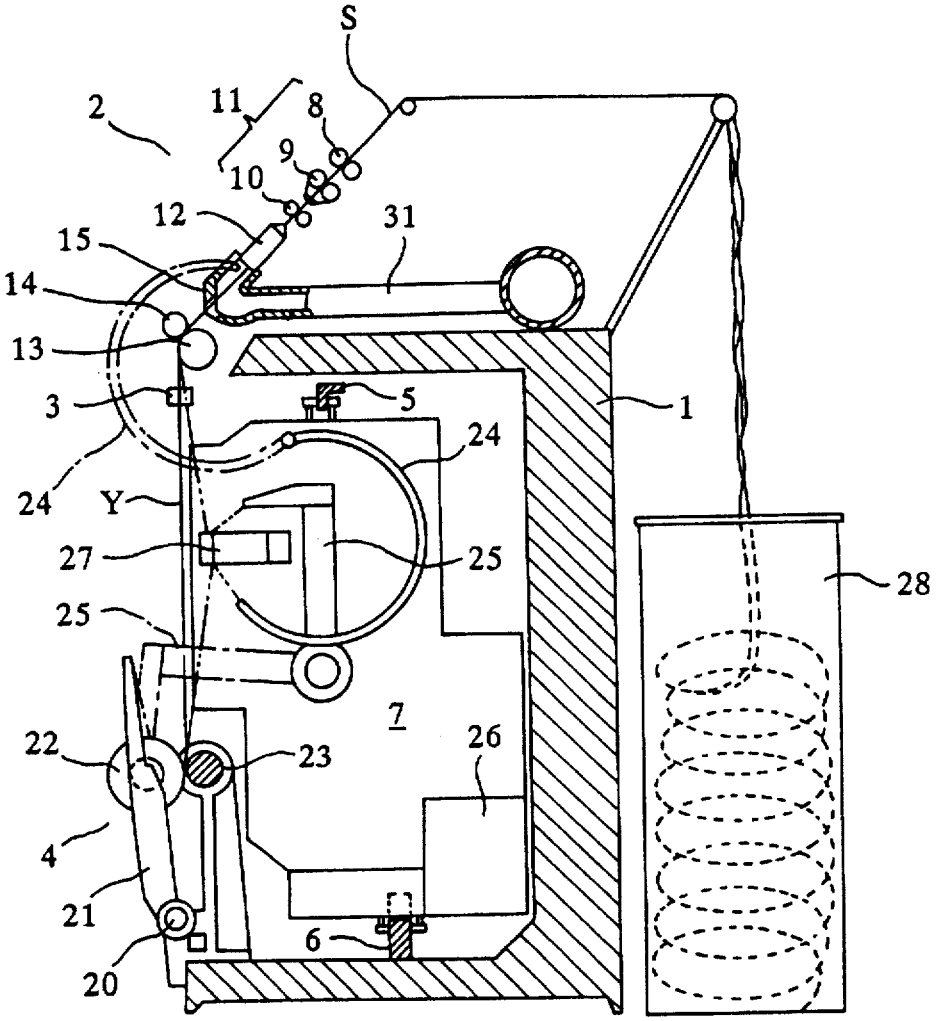
FIG. 1 PRIOR ART
FIG. 1 is a partial cross-sectional view of a single spindle of a conventional Murata MJS machine.
Figure 2:
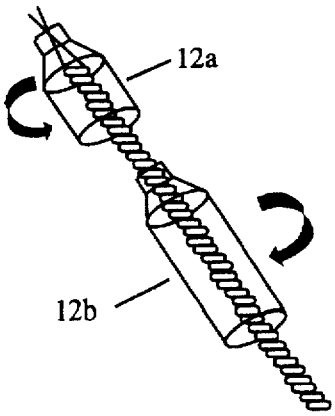
FIG. 2 PRIOR ART
FIG. 2 is a conceptual representation of the action of the air jets in the MJS machine.
Figure 3:
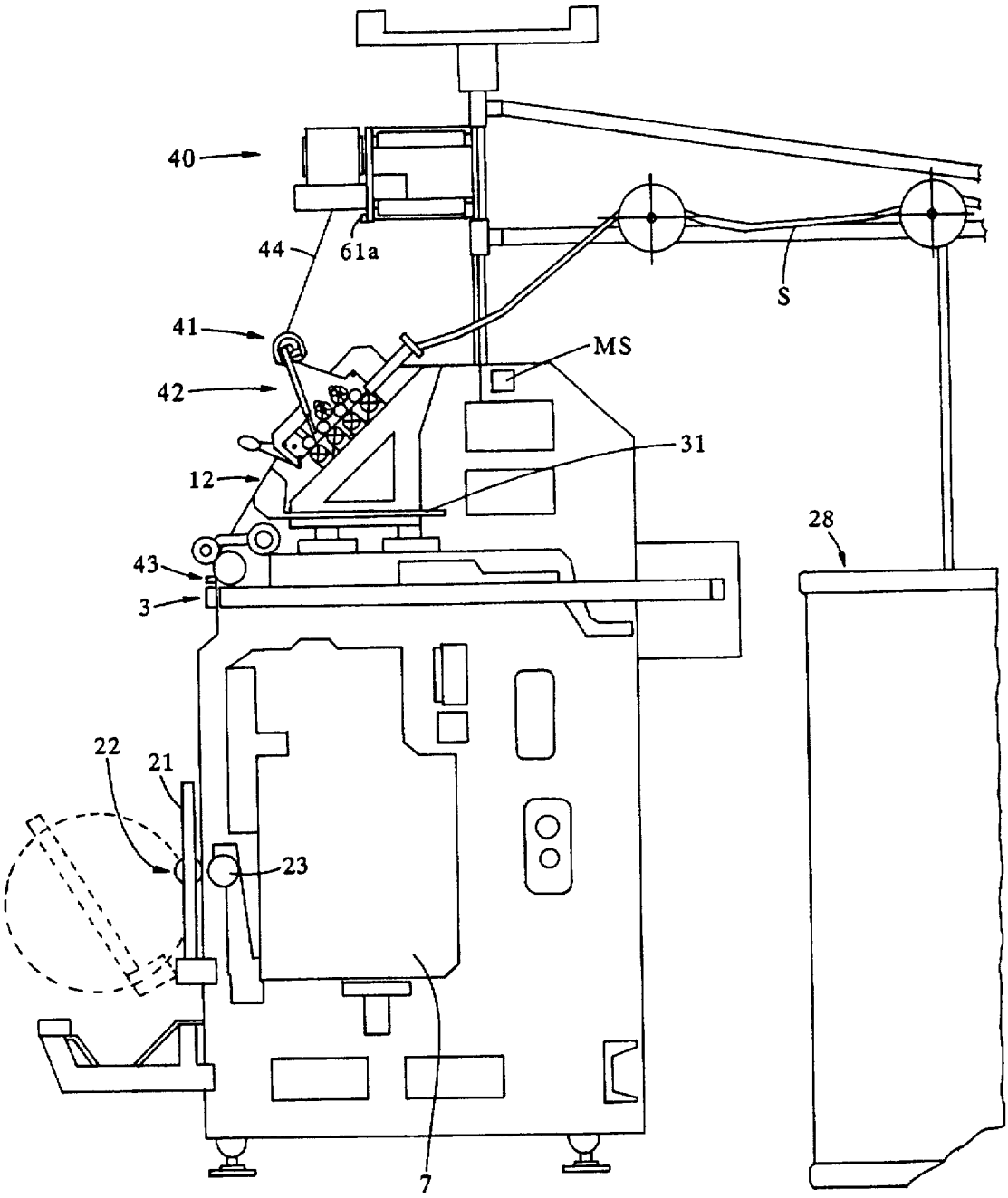
FIG. 3 is a side view of a single spindle of an MJS machine modified in accordance with the present invention.

FIG. 3 shows a side view of a single spindle of a Murata MJS machine, modified to include the features of the present invention. Like numerals represent like structure or elements in FIGS. 1 and 3. The improvements which the present inventors have made to the MJS machine to enable mass production of elastomeric core/wrap yarn are collectively referred to hereinafter as a yarn feed system, although each individual component of the system has other utilities in addition to that explained herein.

The yarn feed system includes a package drive assembly 40, yarn motion and presence sensor 41, an improved drafting assembly 42 and a yarn clearer (e.g., Seletex®) delay cylinder 43. An elastomeric yarn 44 is delivered from the package drive assembly 40, over the sensor 41 and into the drafting assembly 42. The elastomeric yarn 44 is combined with the sliver S in the air jet spinner nozzle 12 to form a core/wrap elastomeric yarn product. A vacuum exhaust conduit 31 is provided for removing stray or excess sliver from the area around the spinner nozzle 12. The core/wrap yarn exits the nozzle 12, passes over the yarn clearer delay cylinder 43, yarn clearer sensor 3, and is wound on take-up roll 22 in a conventional manner.

Each component of the yarn feed system is explained below herein.

Package Drive Assembly

FIG. 4 is a side view of the yarn supply creel package drive assembly 40 according to the present invention. The drive assembly has a mounting plate 51 which is positioned above an individual spinner station as shown in FIG. 3. The mounting plate 51 is oriented substantially perpendicular to the horizontal plane of the floor on which the spinner station is positioned. A slide block slot 52 is formed in the center region of the thickness of mounting plate 51, and a slide block 53 is positioned in the slot 52. FIG. 5A, which is a front view of the package drive assembly of FIG. 4 without the creel package 50 and package tube holder 56, shows that the slide block slot 52 is substantially rectangular in shape and extends vertically in the length direction of the mounting plate 51. The slide block 53 can move up and down in the slot 52.

A creel package tube holder shaft slot 54 is formed through the front face 51*a* of the mounting plate 51 to communicate with the slide block slot 52. FIG. 5A shows that the slot 54 is substantially concentric with the slot 52, and that the slot 54 is oblong and extends vertically along the length of the mounting plate 52. A package tube holder shaft 55 extends through slot 54 and is fixed in the front surface 53*a* of slide block 53. A freely rotating package tube holder 56 is arranged on shaft 55, and the axes of both holder 56 and shaft 55, collectively the creel package tube holder subassembly, are oriented substantially perpendicularly to mounting plate 51.

A first tab 57 extends perpendicularly from rear surface 51*b* of mounting plate 51 in a region spaced below and in alignment with the major axis of the oblong slot 54. A second tab 58 extends perpendicularly from rear surface 53*b* of slide block 53 and is spaced above and in alignment with the major axis of the oblong slot 54. Another slot (not shown) is formed in rear face 51*b* of mounting plate 51 so that tab 58 can be fixed to slide block 53. A coil spring 59 connects the first and second tabs to bias the package tube holder subassembly 55,56 in a vertically downward direction. Tab 58 is positioned above the axis of shaft 55 to relieve some of the cantilever forces applied to shaft 55 by the weight of creel package 50.

A package drive roller 60 is positioned on mounting plate 51 below the package tube holder subassembly. A shaft 61*a* of a stepper drive motor 61 passes through mounting plate 51 and extends perpendicularly from the front face 51*a* thereof. The package drive roller 60 is fixed to shaft 61*a* of motor 61 such that drive roller 60 also extends perpendicularly from the front face 51*a* of mounting plate 51. FIG. 5A shows that the axis of the drive roller 60 and the axis of the package tube holder shaft 55 are preferably located in the same vertical plane.

To operate the package feed mechanism of the present invention, a creel package 50 is mounted on package tube holder 56 so that the outer peripheral surface of the creel package contacts drive roller 60. Oblong slot 54 and slot 52 allow vertical movement of shaft 55 and slide block 53, to accommodate creel packages of various diameters. Coil spring 59, along with normal gravitational forces, provides sufficient pressure between creel package 50 and drive roller 60 to enable the drive roller to drive the creel package to meter yarn from the creel package at a desired constant speed.

The yarn wound on creel package 50 is drawn at nip 62 formed between drive roller 60 and creel package 50. The yarn is then fed over yarn sensor 41 and into the thread-up device of drafting assembly 42. The speed of motor 61 is controlled by a microprocessor-based printed circuit board 310 (described below) to correspond to the speed of the other components of the spindle. The extent of drafting or stretching of the spandex yarn can be changed by adjusting an electronic setting at the end of the machine. This one setting controls all the spindles on the machine. As yarn is drawn off creel package 50, the diameter of the creel package decreases and the package holder subassembly moves in the vertically downward direction. That is, slide block 53 moves down slot 52 and shaft 55 moves down oblong slot 54. This movement is encouraged by the biasing provided by spring 59 and normal gravitational forces, such that sufficient pressure is always provided between creel package 50 and drive roller 60. Such pressure is desirable to insure that drive roller 60 positively drives creel package 50 and uniformly delivers a continuous supply of yarn from the creel package to the thread-up device at a desired constant yarn speed.

In a preferred embodiment of the invention the creel package holds elastomeric yarn, e.g., spandex. Due to the high elasticity of spandex, the motor 61 should have a high acceleration rate up to the desired feeding speed to insure that no stretch component breakage of the yarn occurs during start-up of an individual spindle. It will be appreciated by those skilled in the art that this package drive assembly permits feed creels of yarn, such as highly elastomeric spandex, to be used, as received from the yarn manufacturer without any re-winding or processing before such yarn is fed into an air jet spinning machine for incorporation into a core/wrap elastomeric yarn. The package drive assembly of the present invention also can be used to deliver any type of yarn or thread to a yarn or thread processing machine, such as an air jet spinner.

The stepper drive motor 61 is specially designed with a skewed rotor and avoids the use of a gear train or expensive frequency invertor. The vibration dampening ability of the creel package on the drive roll and the skewed rotor avoid resonance frequencies than can cause this type of motor to break lock or stall.

FIG. 5B shows a modified version of the package drive assembly, wherein two auxiliary rollers 60*a* and 60*b* have been added. The auxiliary rollers prevent tension and extension yarn loss back to package 50. The avoidance of such tension loss reduces spandex end entrapment on the creel package which can cause unnecessary end breakage, thus reducing machine efficiency. The auxiliary rollers are driven by the drive roller 60 via belts. That is, an endless drive belt is connected directly between drive roller 60 and second auxiliary roller 60*b*, while a second belt, twisted in a figure-eight, is connected between drive roller 60 or second auxiliary roller 60*b* and first auxiliary roller 60*a*. Thus, first auxiliary roller 60*a* rotates in a direction opposite to that of drive roller 60 and second auxiliary roller 60*b*. One or more of the rollers may have grooves therein for positioning the belts. The path of the yarn 44 is shown in FIG. 5B. These auxiliary rollers also may be driven electronically, via a motor, but belts are typically used to avoid additional expense.

Yarn Motion and Presence Sensor

While it has been known to use optical or capacitive sensors in textile machines, e.g., Peyer, Loepfe, Uster, or Seletex® yarn clearers, to detect the presence and quality of yarn, elastomeric yarns present unique sensing problems. The elastomeric yarn used in the present invention typically is drawn at a ratio that reduces the yarn denier to as low as 3 denier, which is finer than human hair. Moreover, since spandex cannot be dyed, it is sometimes desirable to use clear spandex yarn to avoid visual detection in the final product. It is difficult to detect such fine yarn, and indeed virtually impossible to detect or see clear yarn with known optical or capacitive sensors used in the textile industry. The yarn motion and presence sensor of the present invention not only can provide precise detection of such clear and fine yarns, but is useful for detecting all types of moving yarn and thread.

The yarn sensor of the present invention incorporates two novel concepts: (1) the use of photomicrosensors to detect rotational speed of an idler wheel, and (2) the use of magnetic eddy currents to provide instantaneous braking of the idler wheel at high speed with minimal braking at low speed.

Figure 6:
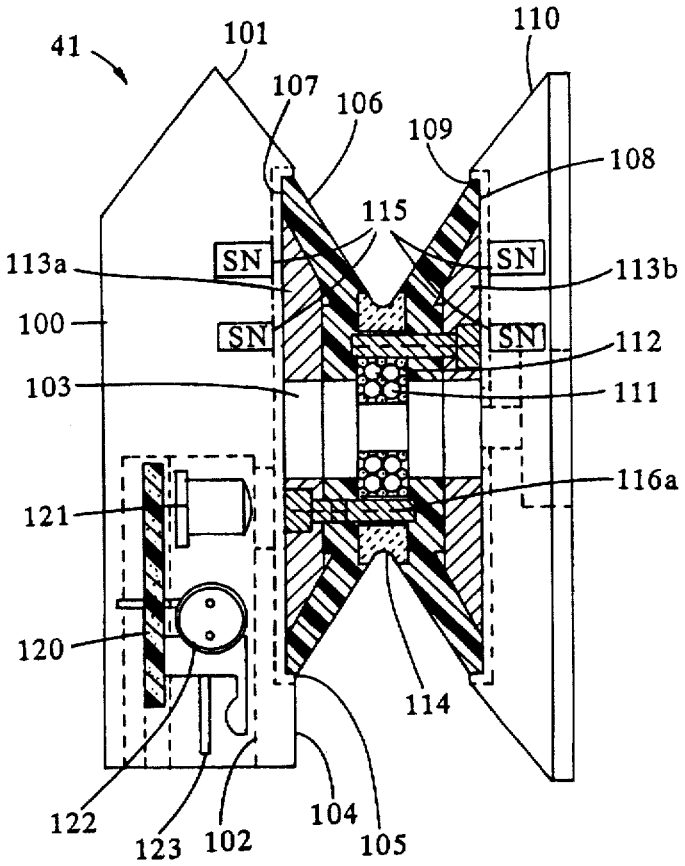
FIG. 6 is a partial cross-sectional view of a yarn motion and presence sensor of the present invention.

FIG. 6 is a cross-sectional view of the motion and presence sensor 41 of the present invention. The sensor includes a transparent housing 100 preferably having a prism shaped outer sector 101 and a recessed bottom 102. A shaft 103 protrudes from a side surface 104 of the housing 100. The side surface 104 has a circular recess 105 therein centered around the shaft 103. A notch idler wheel 106 is mounted on the shaft 103 and is freely rotatable thereon. One of opposed sides 107 of the idler wheel extends into the recess 105 to prevent lint or extraneous material from entering the interface region between the wheel 106 and shaft 103, thereby impairing the free-spinning ability of the idler wheel. The other one of opposed sides 108 of the idler wheel extends into a circular recess 109 formed in an idler wheel extension member 110 fixed to the end of the shaft 103. While the housing 100 and extension member 110 are fixed, the idler wheel 106 rotates freely on shaft 103.

A bearing 111 is preferably fixed in inner bore 112 of the idler wheel to facilitate rotation of the idler wheel on shaft 103. Metal disks **113*a*,113*b* are secured to or within opposed sides 107,108 of idler wheel 106**. The metal disks should be made of non-magnetic materials such as aluminum, magnesium, stainless steel, or brass, although aluminum is preferred because of its low density, for reasons explained below, and low material cost. A ceramic coated, all metal idler wheel can also serve the same purpose.

While the idler wheel 106 is typically plastic, a high hardness (e.g., ceramic) ring 114 is formed at the bottom of the notch in the idler wheel to prevent destruction by abrasion of the wheel due to contact with the yarn passing over the wheel. The wheel 106 is frictionally driven by the yarn 44 (FIG. 3) passing over it.

Figure 7:
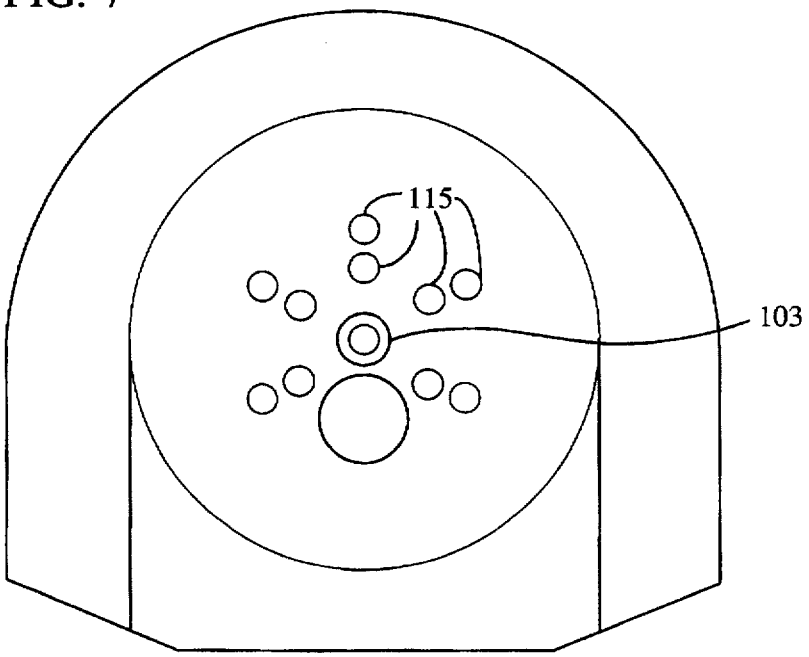
FIG. 7 is a side view of the yarn motion and presence sensor with the idler wheel removed.

A plurality of magnets 115 are arranged on opposite sides of the idler wheel in housing 100 and extension member 110. FIG. 7, a side view of housing 100 without idler wheel 106 and extension member 110, shows that the magnets are preferably arranged along concentric circles in housing 100 (and preferably also in extension member 110). It is preferred that the magnets in housing 100 align with the magnets in extension member 110, and that the N-S orientation of opposed magnets in the housing and extension member be in the attraction mode, as shown in FIG. 6. Although any number of magnets can be used in any number of arrangements, the magnets 115 in each of housing 100 and extension member 110 should be spaced from each other to prevent cancellation of the magnetic fields from magnet to magnet. A preferable material for such magnets is an Nd-Fe-B alloy.

The magnets 115 operate to produce magnetic eddy currents through the metal disks **113*a*,113*b* during rotation of idler wheel 106. The magnetic eddy currents are very weak or non-existent during initial start-up rotation of idler wheel 106, so that the idler wheel inertia at start-up of rotation is very low, and thus the idler wheel initially spins very freely. When idler wheel 106 is rotating at normal operating speed, the magnetic eddy currents are very strong. Aluminum is preferred for the metal disks 113*a*,113*b*, because the density of other non-magnetic materials, e.g., gold, would create more moving inertial force or momentum of the idler wheel 106** than possible for the eddy currents to instantaneously decelerate. The idler wheel should not contain any ferrous or otherwise magnetic materials (such as screws) because such materials may cause undue additional continuous or pulsed magnetic drag.

Figure 8:
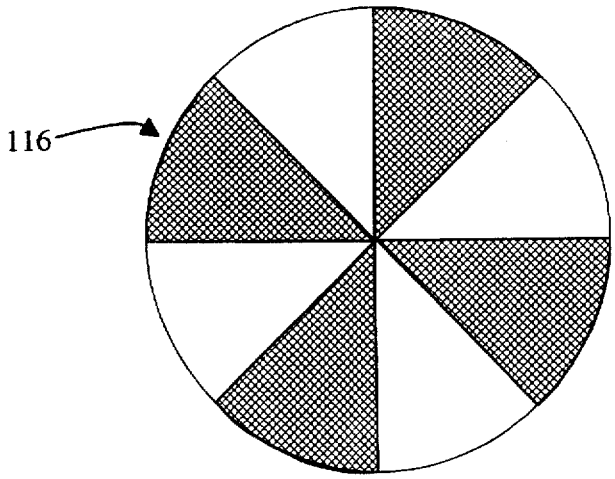
FIG. 8 is a side view of a pattern formed on the idler wheel.

A circuit board 120 is mounted in the recessed bottom of the transparent housing 100 as shown in FIG. 6. The circuit board includes a photomicrosensor 121, which is a combined IR phototransistor and IR LED. Photomicrosensors of this type are sold by Omron, under product designation number EE-SMR3-1. The photomicrosensor emits an IR beam from the IR LED which is reflected from a pattern 116 (FIG. 8) formed on the side 107 or disk **113*a* of idler wheel 106 as rotation of wheel 106** passes the pattern segments through the IR beam. It is important that the pattern formed on the side of the idler wheel be perfectly centered around the axis of the wheel to ensure accurate detection of wheel speed.

Instead of sensing a pattern provided on the idler wheel 106, the photomicrosensor can also detect stainless steel, aluminum or other non-magnetic material mounting bolts **116*a* used to mount the metal disk 113*a* on the side 107 of the idler wheel 106. The reflected IR beam is detected by the IR phototransistor to create a voltage signal. The phototransistor generates voltage proportional to the amount of detected IR light reflected from pattern 116. The voltage signal and voltage frequency are processed by the microprocessor 310 to derive an average rotational speed of the idler wheel 106** and thus a linear speed of yarn passing thereover.

In the event of yarn breakage, idler wheel 106 is no longer positively driven by yarn. Immediately after yarn breakage, the strong magnetic eddy currents induced in the metal disks **113*a*,113*b* by the magnets 115 act as a brake, causing substantially instantaneous reduction in rotational speed of idler wheel 106. The faster the rotational speed just before yarn breakage, the greater the braking power immediately after yarn breakage. In contrast, slower wheel speeds result in lower braking power by not generating as strong magnetic eddy currents. The microprocessor will detect, via the photomicrosensor 121, the instantaneous decrease in rotational speed of idler wheel 106** and cause the entire system to shut down, as explained later herein.

Also mounted on the circuit board is an alarm LED 122 which is illuminated when yarn breakage occurs and there is an accompanying decrease in speed detected by the photomicrosensor 121. The prism-shaped outer surface 101 of the housing 100 distributes the light emitted by the alarm LED 122 in several directions for easy visual detection by a human operator from multiple viewpoints.

The circuit board also includes a connector 123 located in the recessed bottom 102 of the housing 100, for electrically connecting the sensor to the microprocessor 310 provided on each spindle. The connector 123 is protected by the walls of the housing 100 which define the recessed bottom 102 of the housing 100.

The housing 100 may be made from transparent injection molded or cast plastic (e.g., polycarbonate, general purpose polystyrene, acrylic, K-resin (a clear/highly crystalline polymer with high impact resistance produced by Phillips Chemicals, Co., Pasadena, Tex.), polyurethane or epoxy), and is thus very inexpensive. The circuitry is also very inexpensive in that only a commercially available photomicrosensor, LED and connector are required to build the sensor. Moreover, the idler wheel 106 may be a standard off-the-shelf item. Accordingly, a very sensitive motion and presence sensor can be provided at very low cost.

Figure 9:
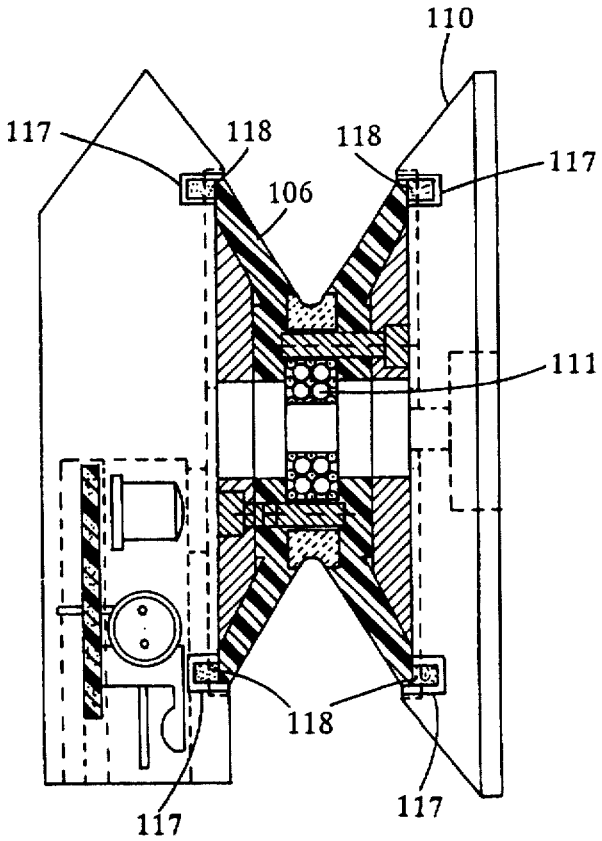
FIG. 9 is a partial cross-sectional view of another embodiment of the yarn sensor of the present invention.

FIG. 9 shows another embodiment of the sensor of the present invention, wherein baffle grooves 117 are provided in the housing 100 and extension member 110, and mating baffles 118 are provided on the idler wheel 106. While the baffles do not inhibit free rotation of the idler wheel 106, they do assist in preventing lint from entering the bearing 111 of the idler wheel. By preventing lint from contacting the bearing 111, the life and reliability of the sensor is prolonged by assuring continuous free rotation of the idler wheel 106.

Figure 10A:
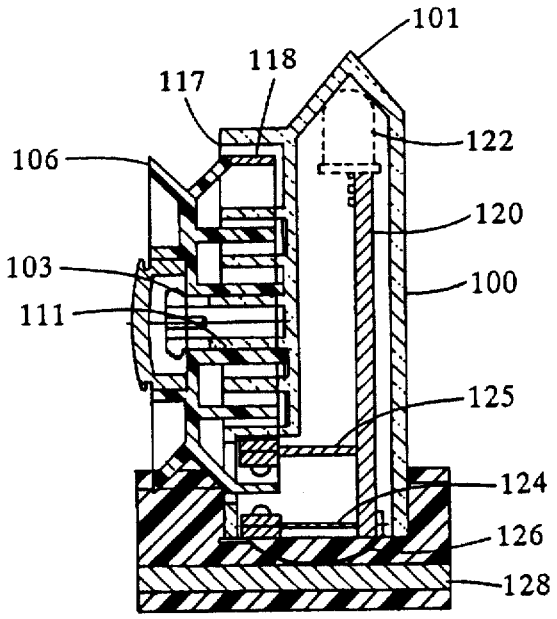
FIG. 10A is a partial cross-sectional view of another embodiment of the yarn sensor of the present invention.
Figure 10B:
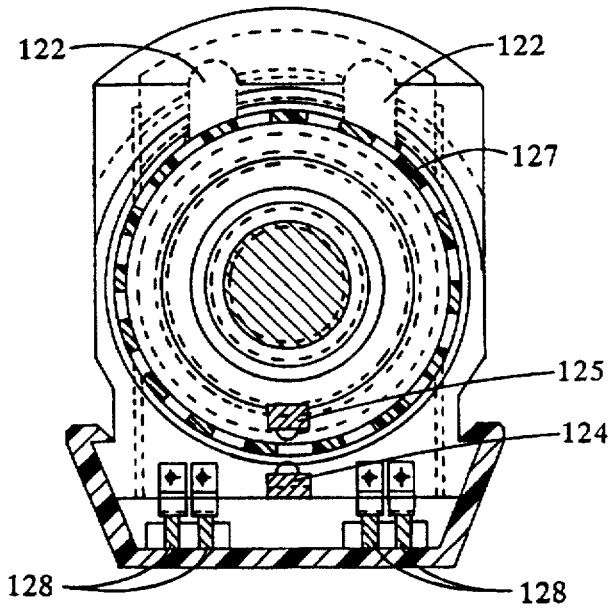
FIG. 10B is a partial cross-sectional side view of the sensor shown in FIG. 10A.

FIGS. 10A and 10B show yet another embodiment of the yarn sensor of the present invention which incorporates the baffle design of FIG. 9, but uses a slightly different sensing mechanism. Like numerals represent like elements in FIGS. 8–10B.

The sensor in FIG. 10A makes use of teeth or holes 127 formed in baffle 118 (FIG. 10B), and an infrared LED 124 and a phototransistor 125 to detect speed of the idler wheel via a direct transmit/receive technique. The teeth or holes 127 interrupt the light transmitted from infrared LED 124 and detected by phototransistor 125. A signal is thus generated by the phototransistor representative of the rotational speed of the idler wheel 106 in the same manner as the sensor of FIGS. 8–9. The LED and phototransistor could also be arranged on opposite sides of the wheel 106 to interact with a pattern of holes formed through the sidewall of the wheel 106.

In the sensor shown in FIGS. 10A and 10B, a contact spring 126 provides electrical communication between the circuit board 120 and power supply rails 128. The power supply rails are slightly different from the connector 123 of FIG. 6, in that the rails 128 (four in total) enable (if desired) direct two-way communication to individual sensors along a central serial data binary bus (not shown), and also supply power to drive the individual sensor circuitry. This bus can simultaneously service a plurality of sensors at the same time along only four wires. This can be achieved at a very low cost by using a set of only four bus rails that run the full length of the machine line. This system is also suitable for installation on other textile machinery, including tufting machines, warping machines, and ring spinning machines. Direct two way communication with an individual yarn sensor can allow various information to be obtained and digested by a computer. The entire machine or individual spindle data can include runability efficiency, total run time, total down time and number of end breaks. Industrial engineering data is beneficial for fine tuning textile machinery for greater throughput productivity. Inexpensive two-way communication can enable the use of devices to stop off-quality product from being produced by shutting down material feed or knocking the end down (e.g., on a ring spinning frame) and allowing the waste to run into the vacuum exhaust conduit 31. This management tool can eliminate off-quality product, reduce waste, and improve machine runability and, hence, profitability.

Preferably, the light emitted from the IR LED in the photomicrosensor 121 is electronically (transistor switching on/off) pulsed to avoid detection of spurious/background light by the IR phototransistor. By pulsing the IR transmission at a specific frequency and pulsing the IR reception at the same frequency, extraneous light can be filtered out since it is not pulsed in sync with the receiver. The phototransistor can also include an optical filter to remove, and thus avoid detection of, extraneous IR light, such as fluorescent lighting and sunlight.

Drafting Assembly

Figure 11:
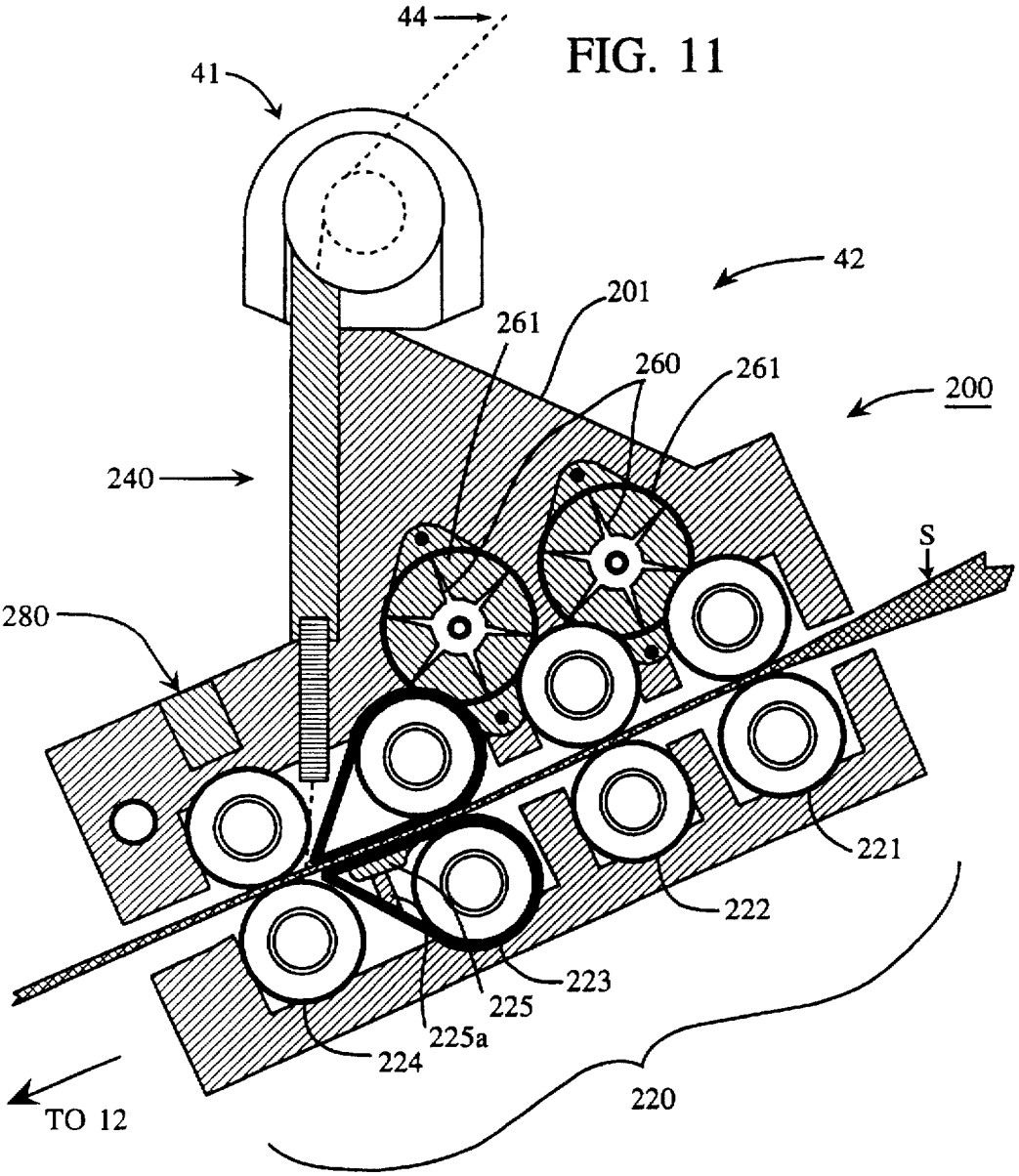
FIG. 11 is a side view of the drafting assembly of the present invention.

FIG. 11 shows in cross-section the improved drafting assembly 42 of the present invention. While a four-roller drafting system is shown, three or five-roller systems can also be used. The assembly has a main body frame 200 including a mounting bracket 201 designed to hold a roller assembly 220, a thread-up device assembly 240, draft zone clearers 260 and a front roll wrap sensor 280.

i) Roller Assembly

The roller assembly 220 is designed to transport staple sliver S from the supply container 28 to the air jet spinner nozzle 12. The roller assembly 220 includes opposed rear rollers 221, opposed intermediate rollers 222, opposed apron rollers 223, and opposed front rollers 224, all of which can come standard on a Murata MJS machine. Each set of opposed rollers forms a nip through which the sliver S passes. The apron rollers 223 stretch and orient the sliver and the front rollers 224 are rotated at a faster speed than the rear rollers 221 and apron rollers 223 to draw the sliver at a desired ratio as it passes through the roller assembly 220. Preferably the upper rollers closest to the mounting bracket 201 are rubber and the bottom rollers are metal. A tensor bar 225 (with height adjustment bracket 225*a*) is provided in the bottom apron roller 223 to regulate the tension of the bottom apron and set the height of the apron nipping action.

ii) Draft Zone Clearers

The advantageous draft zone clearers 260 of the present invention are arranged on the mounting bracket 201 above and between the upper intermediate roller 222 and upper apron roller 223, and above and between the upper intermediate roller 222 and upper rear roller 221. Each clearer 260 resembles a paddle wheel and is substantially star shaped, e.g., six vaned, in cross section. The clearers are each driven by a dedicated electric motor 261 mounted directly on the mounting bracket 201. The clearers 260 can be rotated in the same or opposite direction as the rotation direction of the upper rollers. The clearers contact the upper rollers to remove lint, dust, stray sliver, or other undesirable material which is then collected and discarded through the vacuum exhaust conduit 31 (see FIG. 3). The clearers can be made from any material that is soft, flexible and durable, e.g., polyurethane, and preferably have a hollow or solid, rigid metal shaft for attaching the clearer to the shaft of the dedicated motor.

During operation it is preferred that the clearer motors are off whenever the roller assembly is off. Also, it is preferred that the clearer motors are cycled on and off to prevent an in-sync condition between the apron and any roller. This cycling insures that the clearer contacts all segments of the upper apron and upper rollers. The cycling also extends the life of the motor and clearer.

iii) Front Roll Wrap Sensor The front roll wrap sensor 280 is located on the mounting bracket 201 opposed to and above the upper front roller 224. The sensor 280 includes a photomicrosensor to detect the occurrence of roll wrap, that is, yarn undesirably wrapped around the upper front roller 224. The photomicrosensor can be the same as that used in the elastomeric yarn sensor and includes an infrared light emitting diode which projects infrared light onto the upper front roller 224. The photomicrosensor also includes a phototransistor to detect infrared light reflected from the upper front roller 224. During initial operation of the drafting assembly 42, the sensor 280 makes an initial detection of the reflectivity of the upper region of the upper front roller and that detection is represented by voltage generated in the phototransistor resulting from the IR light reflected from the upper front roller 224. If roll wrap occurs, yarn begins to wrap around the circumference of the upper front roller 224, and the presence of that roll wrap yarn increases the amount of light reflected back into the phototransistor of the photomicrosensor. The increased detected reflectance increases the voltage generated by the phototransistor, which in turn is monitored by the microprocessor 310 (explained below). Any significant increase in reflectance (e.g., ≧10%) will shut-down the drafting assembly, as explained below herein.

iv) Thread-UP Assembly

Figure 12A:
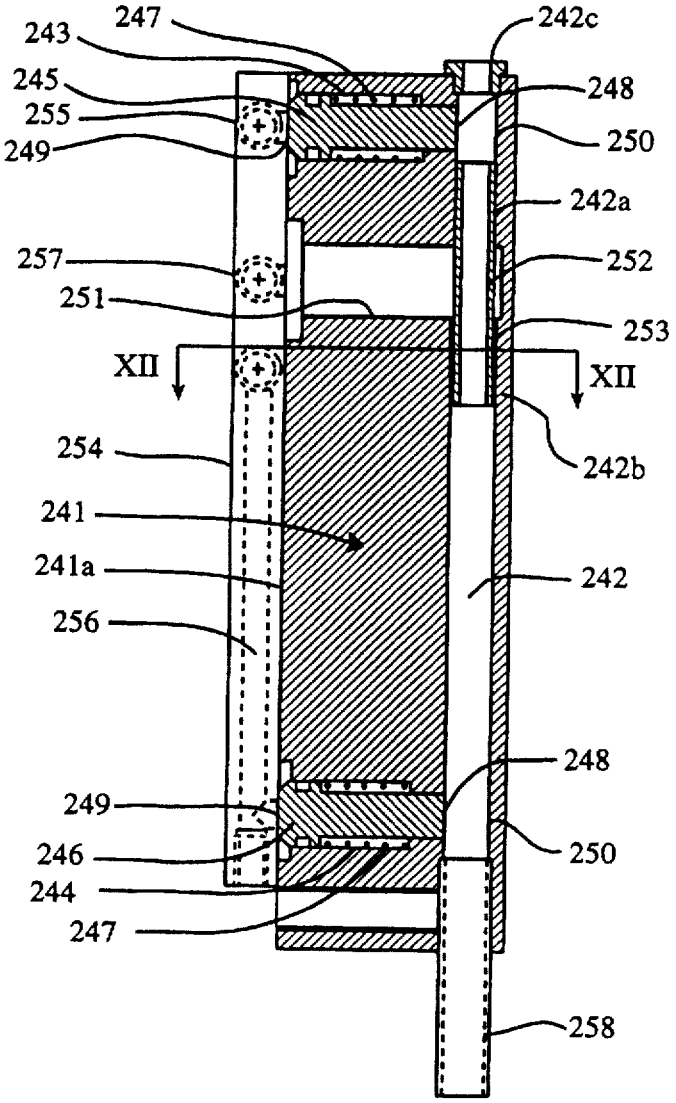
FIG. 12A is a cross-sectional view of the thread-up device of the present invention.

The thread-up assembly 240 is shown in cross-section and greater detail in FIG. 12A. The device includes a main body 241 having a yarn delivery bore 242 passing through the length thereof. The axis of the bore 242 should be arranged at an angle of 30°–60°, preferably about 50°, relative to the direction of sliver feed through the drafting assembly. See again FIG. 11. This arrangement will ensure fewer airjet nozzle chokes and roll wraps, and increases the chance for the spandex end to be entrained by the front roll nip point, and then the first airjet nozzle.

First and second bores 243, 244 extend through a side surface 241*a* of the main body to communicate with the yarn delivery bore 242. Arranged in the first 243 and second 244 bores are pneumatic pistons 245, 246, respectively. Each of the pistons is biased by a spring 247 away from the yarn delivery bore 242. Each piston has an inner end 248 arranged adjacent the yarn delivery bore 242, and an outer plunger end 249 arranged proximate the side surface 241*a* of the main body. The inner end 248 of each piston mates with an inner surface portion 250 of the bore 242.

Figure 12B:
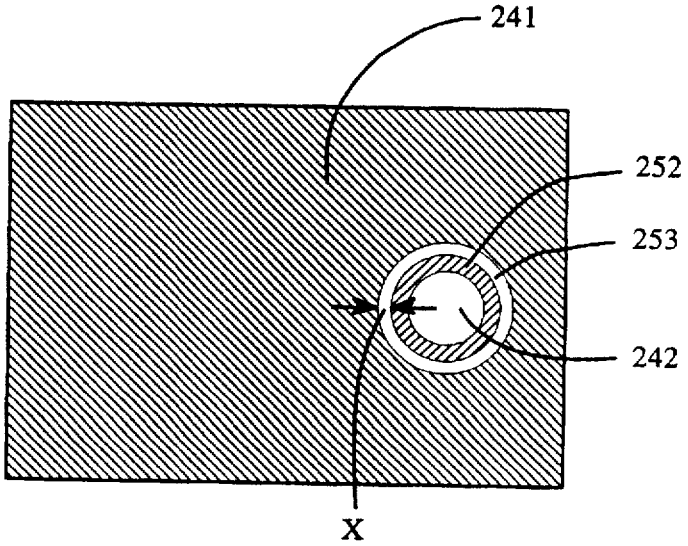
FIG. 12B is a cross-sectional view taken along line XII—XII of FIG. 12A.

A third bore 251 extends through the main body from the side surface 241*a* thereof to extend across and communicate with the yarn delivery bore 242. An air delivery tube 252 is arranged in the yarn delivery bore 242 and intersects a portion of the third bore 251. The upper end of the tube 252 is fixed in the upper portion 242*a* of the yarn delivery bore 242. The lower end of the tube 252 extends into the lower portion 242*b* of the yarn delivery bore 242, and an annular gap 253 is defined therebetween (FIG. 12B). The annular gap 253 ranges from about 0.002 inches to about 0.030 inches in radial dimension "x", and preferably is about 0.005 inches in order to reduce air flow and maintain high thread-up aspiration below the tube 252. Instead of using such an annular gap, air can be supplied by adding an additional small diameter bore of approximately 0.032" at an angle of 15° off the yarn delivery bore.

A conduit block 254 is attached to the side surface 241*a* of the main body 241, and provides air supply conduits 255,256 and 257 in communication with each of the first 243, second 244, and third 251 bores, respectively. Solenoid valves (not shown) are provided for each of the conduits 255, 256 and 257 to control air flow therethrough. During operation of the thread-up device, air is supplied to the outer plunger ends 249 of each piston to actuate each piston selectively, such that the inner ends 248 are forced into contact with the corresponding inner surfaces 250 of the bore 242. The upper piston 245 acts as a clamp for the yarn passing through the yarn delivery bore 242. The lower piston 246 acts as a clamp/cutter for the yarn, since continued rotation of the front rollers 224 after the lower piston 246 is actuated will stretch and break the yarn 44 below the lower piston 246. The air pressure supplied to each piston ranges from about 30 to 200 psi, and is preferably about 100 psi.

The air supply conduit 257 provides air to the third bore 251 and into the yarn delivery bore 242 via the annular gap 253 defined between the lower end of the tube 252 and the lower portion 242*b* of the yarn delivery bore 242. The air thus entering the bore 242 is laminar and concentrated at the periphery of the bore 242 such that a suction effect occurs in the bore 242. This suction effect insures proper feeding of the yarn 44 material through eyelet 242*c* of the bore 242 and out extension pipe 258. The air pressure supplied to bore 251 ranges from about 20 to 120 psi, and preferably is about 50 psi.

The spandex yarn finally travels through extension pipe 258 before merging with the drafted sliver. Although the extension pipe is shown as a cylindrical tube in FIG. 12A, the interior thereof preferably gradually tapers down from about 3/16" to about 1/8", allowing better front-to-back and side-to-side aiming of the fired spandex before redirection by the front roll. This slight taper results in minimum disruption of air flow while improving control of directing the spandex into the front roll.

Figure 13A:
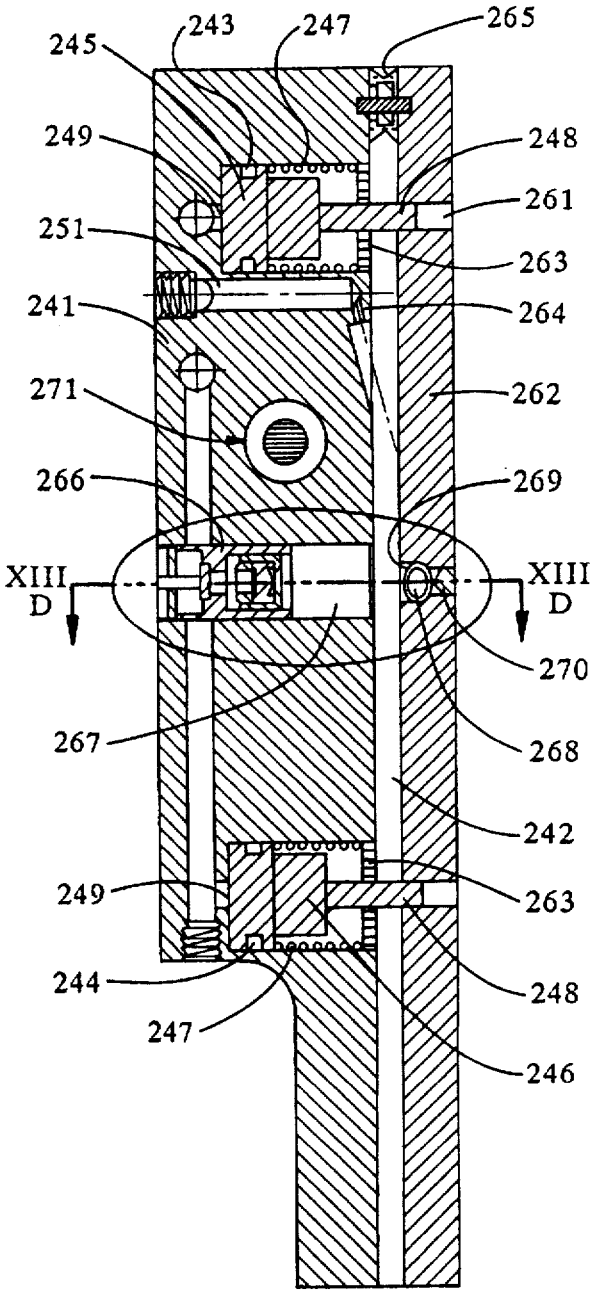
FIG. 13A is an alternative embodiment of the thread-up device and yarn sensor of the present invention.

FIG. 13A shows an alternative embodiment of the thread-up assembly of the present invention. Wherever possible like reference numerals have been used to designate like structure in FIGS. 12A and 13A.

Figure 13B:
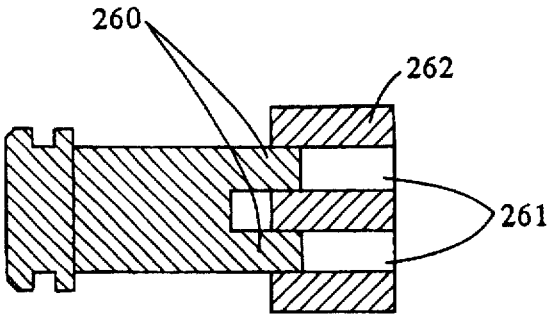
FIG. 13B shows the top view of each piston 245,246 of FIG. 13A, as it interacts with side plate 262.

The thread-up assembly of FIG. 13A includes a main body 241 having a square yarn cross-section delivery bore 242 passing through the length thereof. Use of a round cross-section bore 242 intersecting with a round cross-section bore 243 causes turbulence of the air passing through the bore 242. This turbulence can be reduced by using a square cross-section bore 242 in combination with the planar-shaped piston ends 248. First and second bores 243, 244 extend through a portion of the main body to communicate with the yarn delivery bore 242. Arranged in the first 243 and second 244 bores are pneumatic pistons 245, 246, respectively. Each of the pistons is biased by a spring 247 away from the yarn delivery bore 242. Each piston has an inner end 248 arranged in the yarn delivery bore 242 and an outer plunger end 249 arranged within the bores 243, 244. FIG. 13B shows a top view of each piston 245, 246 as it interacts with side plate 262, which cooperates with the main body 241 to define the square cross-section yarn delivery bore 242. The inner end 248 arranged in the yarn delivery bore includes two prongs 260 which ride within corresponding grooves 261 of the side plate 262. When each piston is in the fully retracted position, the prongs 260 define the side walls of the yarn delivery bore 242 at the location of each piston. That is, the square hole passing through each piston inner end 248 is roughly the same dimension as that of the square yarn delivery bore 242. Guide disks 263 are provided in each bore 243, 244, to guide the inner end 248 of each piston and to provide stop points for coil springs 247 provided in bores 243, 244.

A third bore 251 extends through a portion of the main body 241 and communicates with the yarn delivery bore 242. An air orifice 264 extends from the end of the third bore 251 at an angle into the yarn delivery bore 242. Air is delivered through the bore 251 and air orifice 264 to force the yarn 44 through the thread-up device.

During operation, the upper 245 and lower 246 pistons function in the same way as the thread-up assembly of FIG. 12A, although in the thread-up assembly of FIG. 13A each piston, when actuated, closes the yarn delivery bore 242, thus clamping and clamping/cutting, respectively, the yarn passing through the yarn delivery bore 242.

Figure 13C:
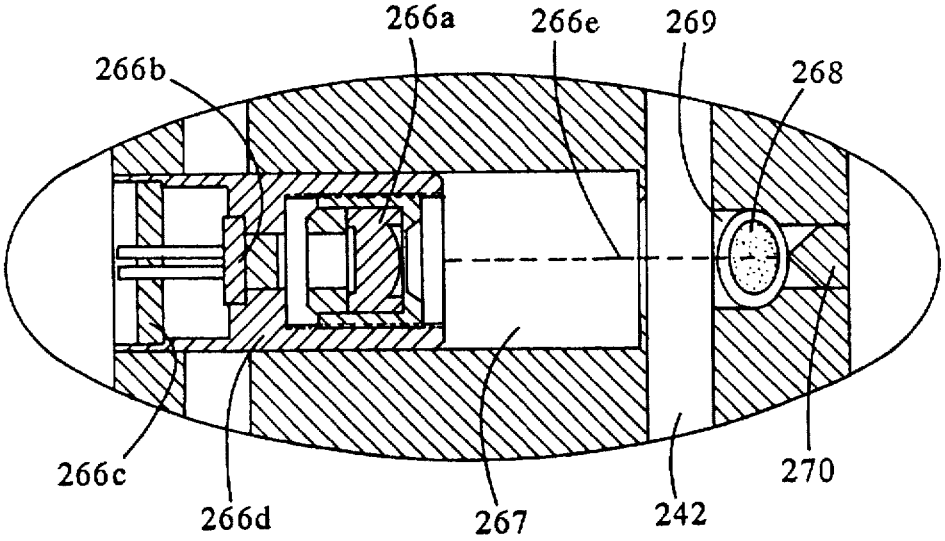
FIG. 13C is an enlarged side view of the encircled area of FIG. 13A.
Figure 13D:
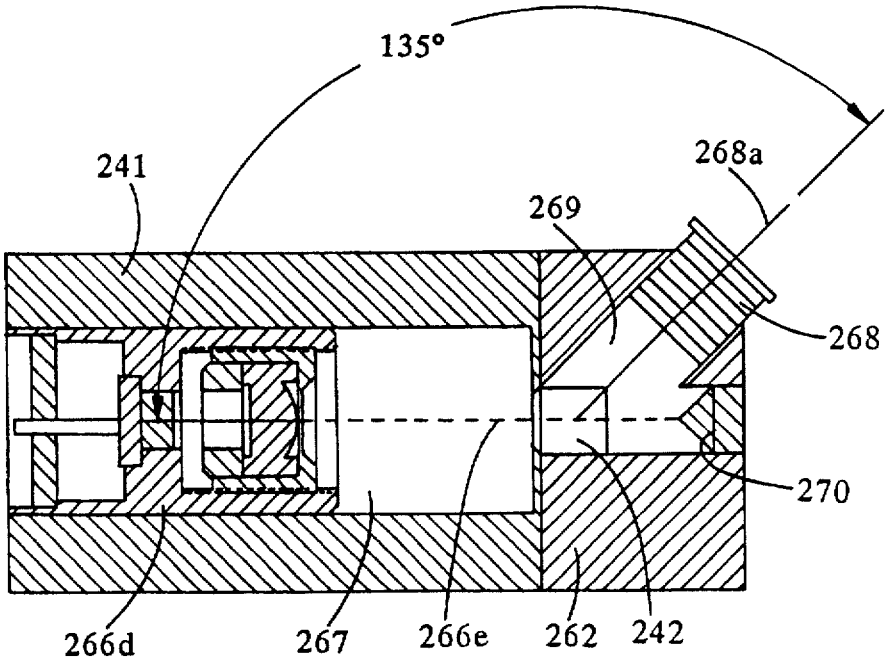
FIG. 13D is a cross-sectional view taken along line XIIID—XIIID of FIG. 13A.
Figure 13E:
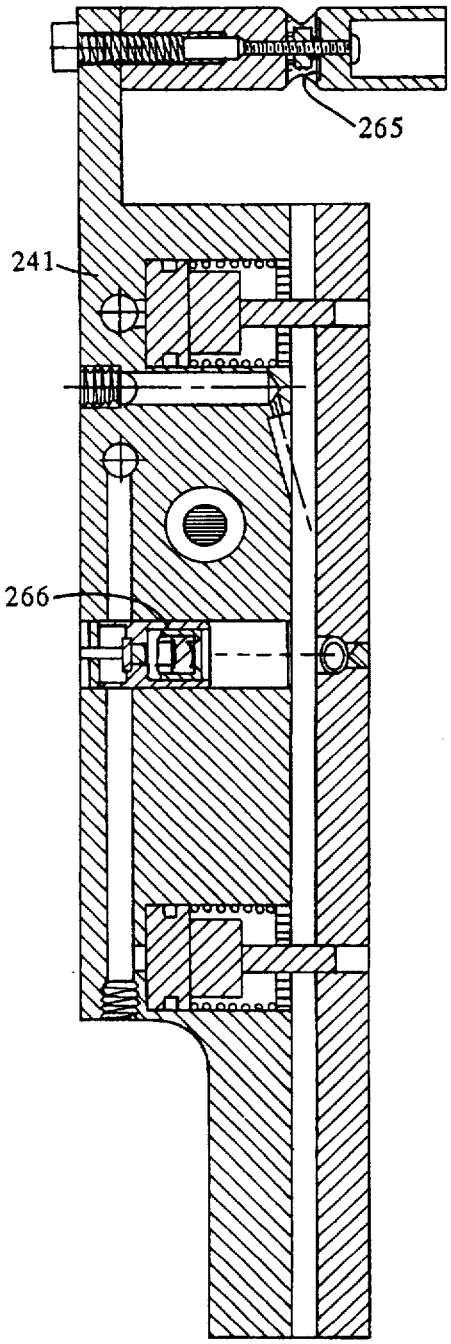
FIG. 13E is an alternative embodiment of FIG. 13A, wherein the idler wheel 265 is positioned outside the main body 241.

Arranged at the inlet end of the thread-up assembly shown in FIG. 13A is a ceramic idler wheel 265 on which the yarn rides as it enters the thread-up assembly. The wheel can also be arranged outside the body 241, as shown in FIG. 13E. The ceramic idler wheel 265 prevents erosive abrasion of the entrance to the yarn delivery bore 242, especially when feeding spandex through the thread-up assembly. The ceramic idler wheel is arranged to be freely rotatable, and preferably the bottom of the V defined by the sidewalls of the wheel is in substantial alignment with the central axis of the yarn delivery bore 242.

FIG. 13A also shows that the presence of the yarn passing through the thread-up assembly can be detected within the assembly itself. Specifically, as shown in the exploded view of FIG. 13C, a laser diode module 266 is arranged in a bore 267 which communicates with the yarn delivery bore 242. The laser diode module includes a lens 266*a*, a laser diode 266*b*, a power rectifier 266*c* and a shell 266*d*. A photodetector 268 is arranged in a bore 269 formed in the back of the thread-up assembly in communication with the yarn delivery bore 242. The photodetector 268 is mounted out of the laser diode generated lightwave beam. The axis 268*a* of the photodetector 268 preferably is arranged at an angle of 135° with respect to the axis 266*a* of the laser diode 266, as shown in FIG. 13D, in order to optimize the sensitivity of the photodetector 268. A laser anti-reflection cone 270 is employed on the opposite side of the yarn delivery bore 242 in alignment with the laser diode 266 to scatter any extraneous light energy emitted from the laser diode 266. In order to attenuate the signal-to-noise ratio for more reliable signal readings and analysis, light bandpass interference filters may be used in front of the photodetector 268 to shield extraneous light from reaching the photodetector, which extraneous light would otherwise skew or distort the true signal generated by the yarn passing through the thread-up assembly. The laser light may also be electronically pulsed or modulated in synchronization with the photodetector to filter additional unwanted light.

As the yarn runs through the lightwave beam, light is reflected and/or refracted toward the photodetector 268 creating a proportional voltage based on the amount of redirected light, which is also directly proportional to the size of the yarn passing through the lightwave beam. With calibration, the speed and size of the yarn passing through the thread-up assembly may be determined. Calibration also may provide other important information when using yarns other than spandex, such as quality consistency (e.g., hairiness, evenness, defect levels, thick, thin, neps) of yarn material passing through the lightwave beam.

As is the case with the yarn motion and presence sensor described above, the output from the photodetector 268 is monitored by the microprocessor to determine, among other things, the presence and/or speed of the yarn passing through the thread-up assembly. A prism-shaped LED alarm light 271 is illuminated whenever the microprocessor fails to detect yarn 44 passing through the yarn delivery bore 242, much like the alarm LED in the yarn motion and presence sensor described earlier herein.

Although any type of laser diode 266 can be employed in the present invention, a high intensity 1 to 5 milliwatt laser operating at 670 nm wavelength and a silicon phototransistor detector 268, has been used. Preferably the laser diode includes a convex plano lens to focus the lightwave beam into the yarn delivery bore.

Figure 13F:
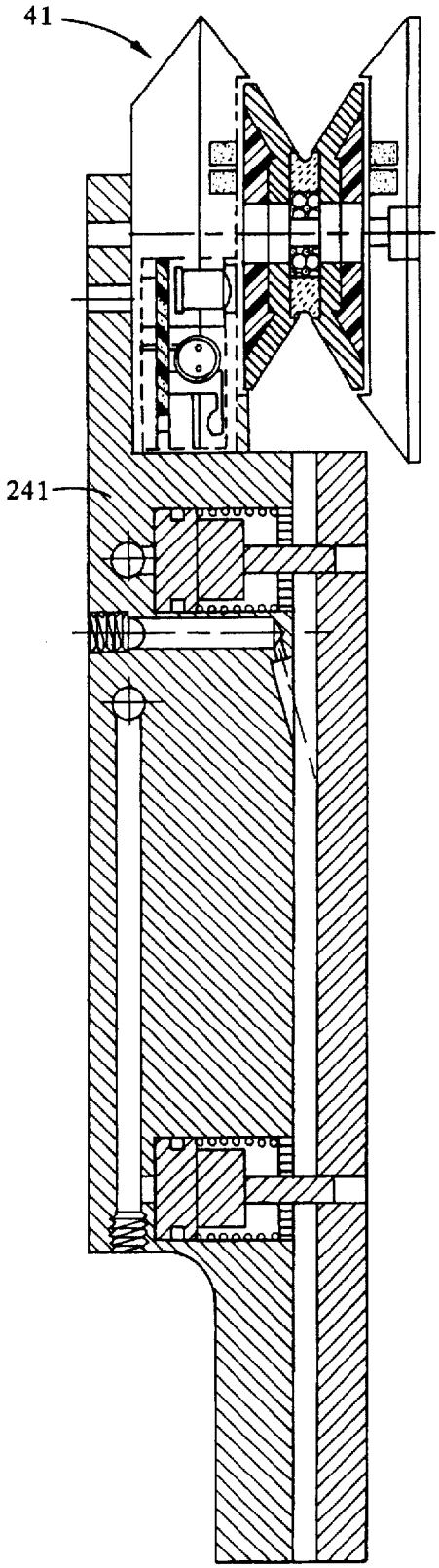
FIG. 13F is an alternative embodiment of FIG. 13A, wherein the sensor of FIG. 6 is employed instead of laser sensor 266.

FIG. 13F shows an alternative embodiment of the thread-up device of FIG. 13A, wherein the sensor of FIG. 6 is employed instead of laser sensor 266.

Yarn Clearer Delay Cylinder

In certain instances that will be explained below, it is necessary to physically move the core/wrap yarn out of registration with the yarn clearer sensor 3. The present invention employs yarn clearer delay cylinder 43 for this purpose.

Figure 14A:
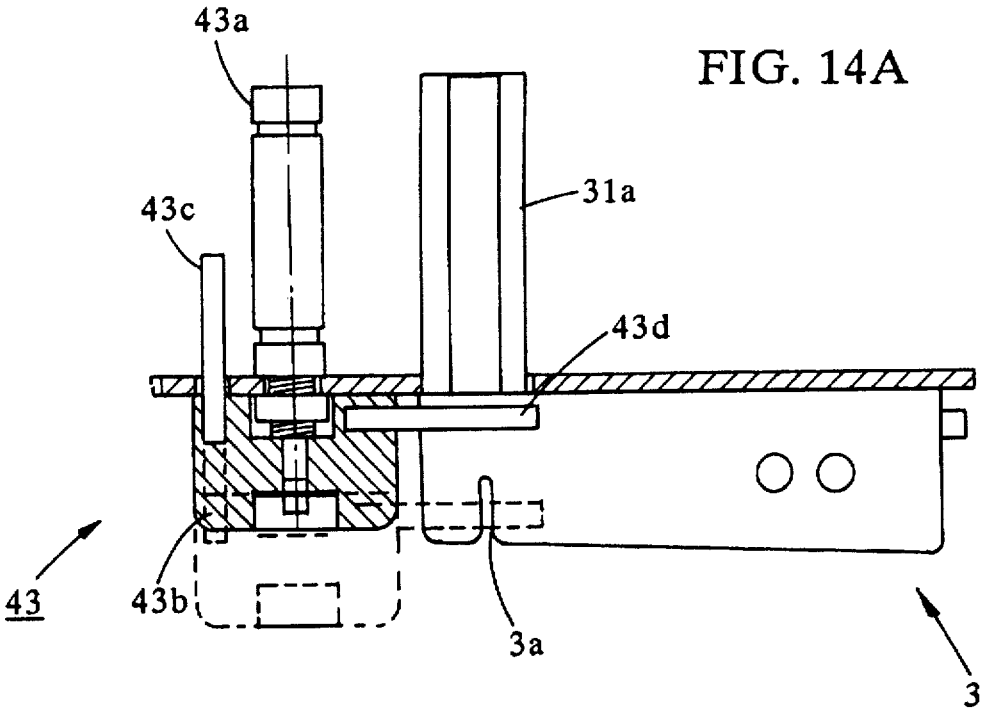
FIG. 14A is a top view of a delay cylinder 43 in accordance with the present invention.

FIG. 14A is a top view showing one embodiment of the yarn clearer delay cylinder 43. The delay cylinder 43 is mounted on the front plate of each spindle as shown in FIG. 3. During normal operation, the final yarn product passes through head slot 3*a* of the yarn clearer sensor 3. The delay cylinder 43 serves to force the yarn out of head slot 3*a*, for reasons explained below. A waste suction duct 31*a* is provided for removing any defective yarn and other debris from the area of the sensor 3.

The delay cylinder 43 includes a solenoid 43*a* having a plunger 43*b* attached to an end thereof. A first pin 43*c* attached to the plunger 43*b* assures axial alignment of the plunger during actuation of the solenoid 43*a*. A second pin 43*d* attached to the plunger forces the yarn product out of head slot 3*a*. The dotted lines in FIG. 14A show the plunger 43*b* in the activated position.

Figure 14B:
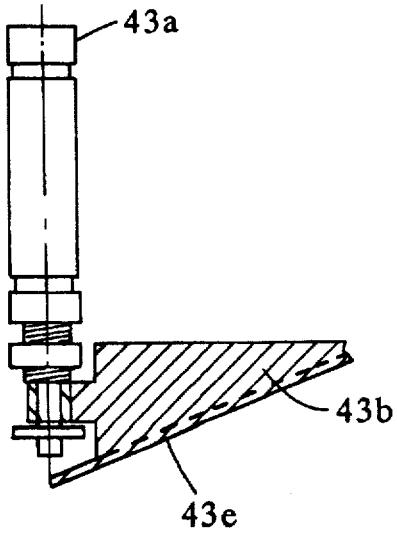
FIG. 14B shows an alternative plunger for the delay cylinder of FIG. 14A.

FIG. 14B shows an alternative embodiment of the delay cylinder 43 of FIG. 14A, wherein the plunger 43*b* is shaped like a triangle with a front edge 43*e* rolled downwardly to provide a smooth surface for contacting the yarn product.

Figure 14C:
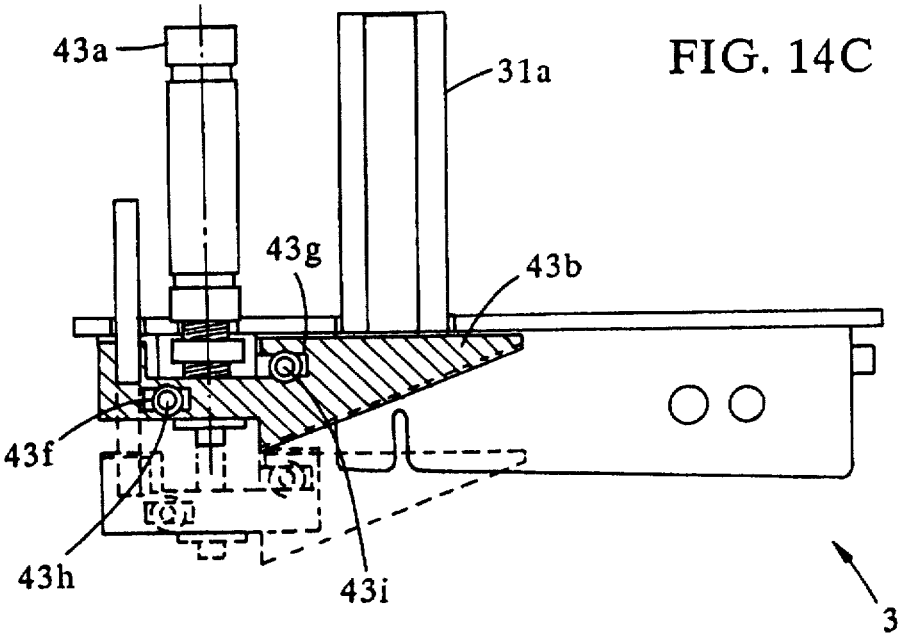
FIG. 14C shows an alternative delay cylinder in accordance with the present invention.

FIG. 14C shows another embodiment of the delay cylinder 43 of FIG. 14B, wherein slots 43*f* and 43*g*, and set screws 43*h* and 43*i* facilitate side-to-side and back-to-front adjustment of the position of the plunger 43*b*.

Figure 14D:
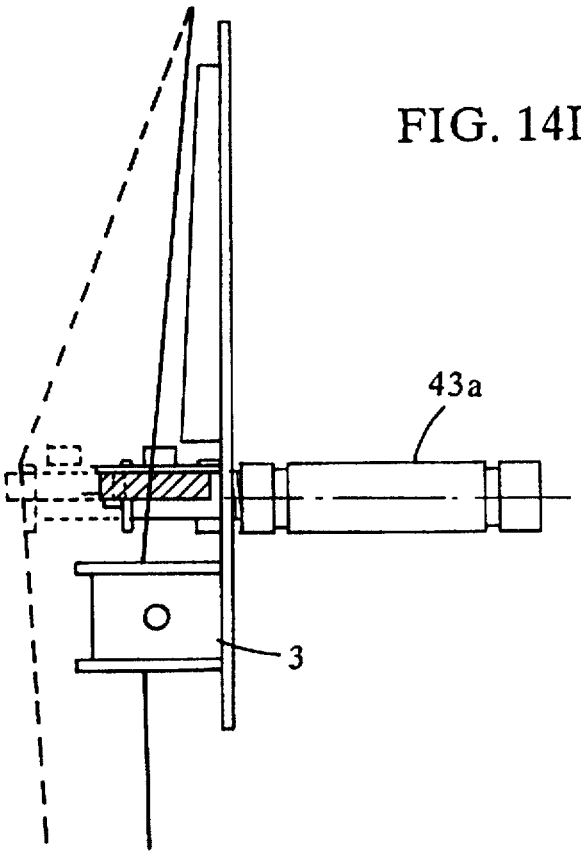
FIG. 14D shows the core/wrap product yarn path, through the sensor 3 and delay cylinder 43.

FIG. 14D shows the delay cylinder 43 with the plunger 43*b* in the retracted position (solid lines) and the plunger 43 in the activated position (dotted lines). When the plunger 43*b* is in the activated position, the yarn product is forced out of head slot 3*a* beyond the sensor 3. It is important, when using capacitance-type sensors 3, to remove the core/wrap product from head slot 3*a* as well as the opening to head slot 3*a*, because the sensing region of such sensors tends to extend somewhat beyond the head slot 3*a*.

Interfacing The Yarn Feed System With a Murata MJS Machine

In developing and testing the yarn feed system of the present invention, a Murata MJS Model 801-9786-4 was used, although other models of Murata's MJS machine may be adapted to accept the yarn feed system of the present invention. The description hereinbelow is in the context of a Murata MJS Model 801-9786-4.

Figure 15:
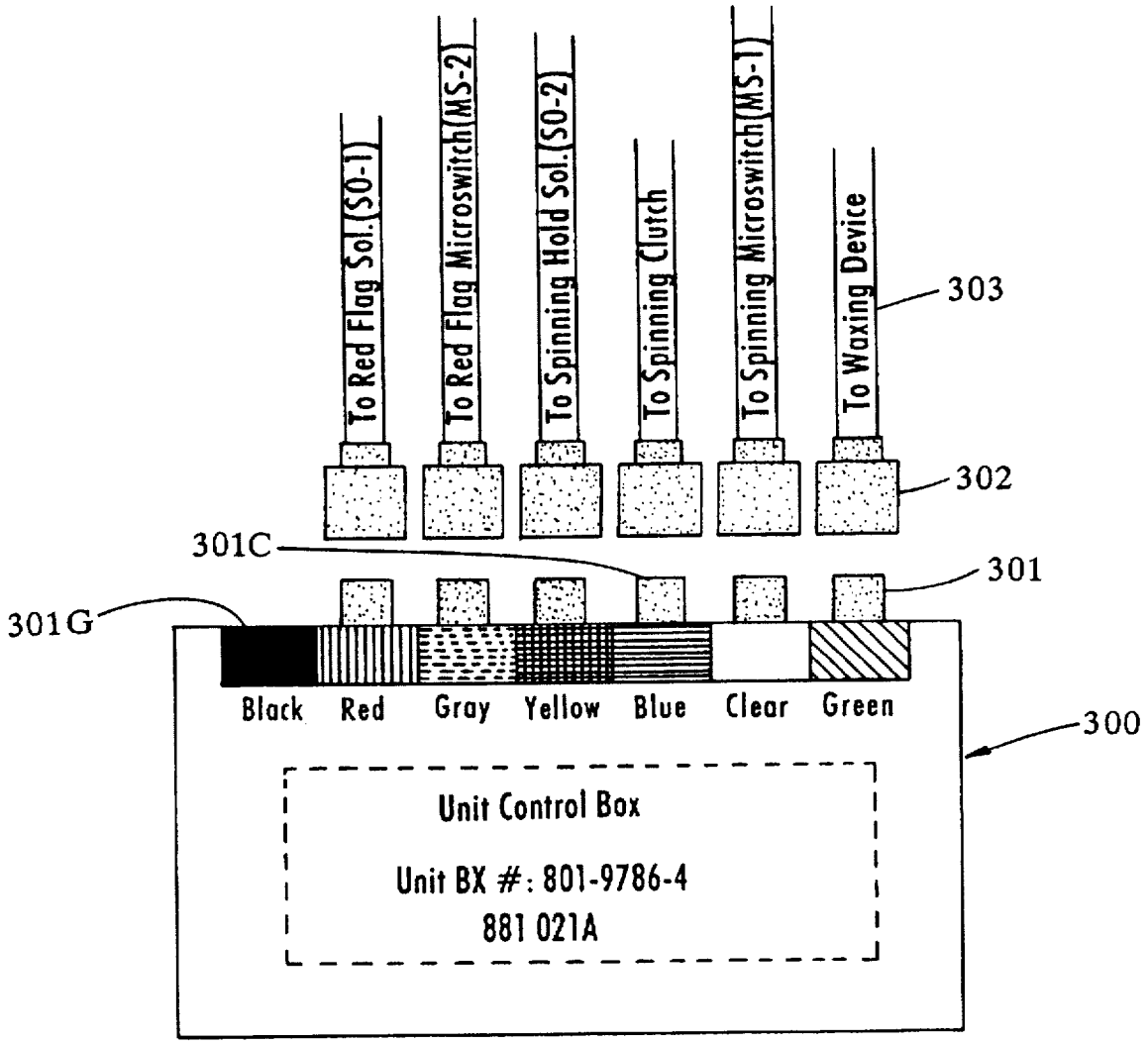
FIG. 15 is a schematic representation of the outputs of a conventional MJS spindle unit control box.

FIG. 15 schematically shows the output configuration of the MJS unit control box 300 which is a standard feature on the MJS machine to control various operations of the machine. Each spindle of the MJS machine has its own unit control box 300. The unit control box 300 includes integrated circuit chips and jacks 301, to which connectors 302 of patch cords 303 are connected, for controlling operation of the spindle in a known manner. For example, one of the jacks 301c, color coded blue, feeds signals to the solenoid (324, FIG. 17) of the spinning/sliver clutch (a standard component on the MJS), which controls the feed of sliver 3 to the drafting assembly 200. Room for a spare jack 301g, color coded black, is provided on the standard MJS unit control box 300.

To seize control of operation of the spindle and incorporate the functions of the yarn feed system of the present invention, each spindle is provided with a second circuit board 310 in accordance with the present invention.

Figure 16:
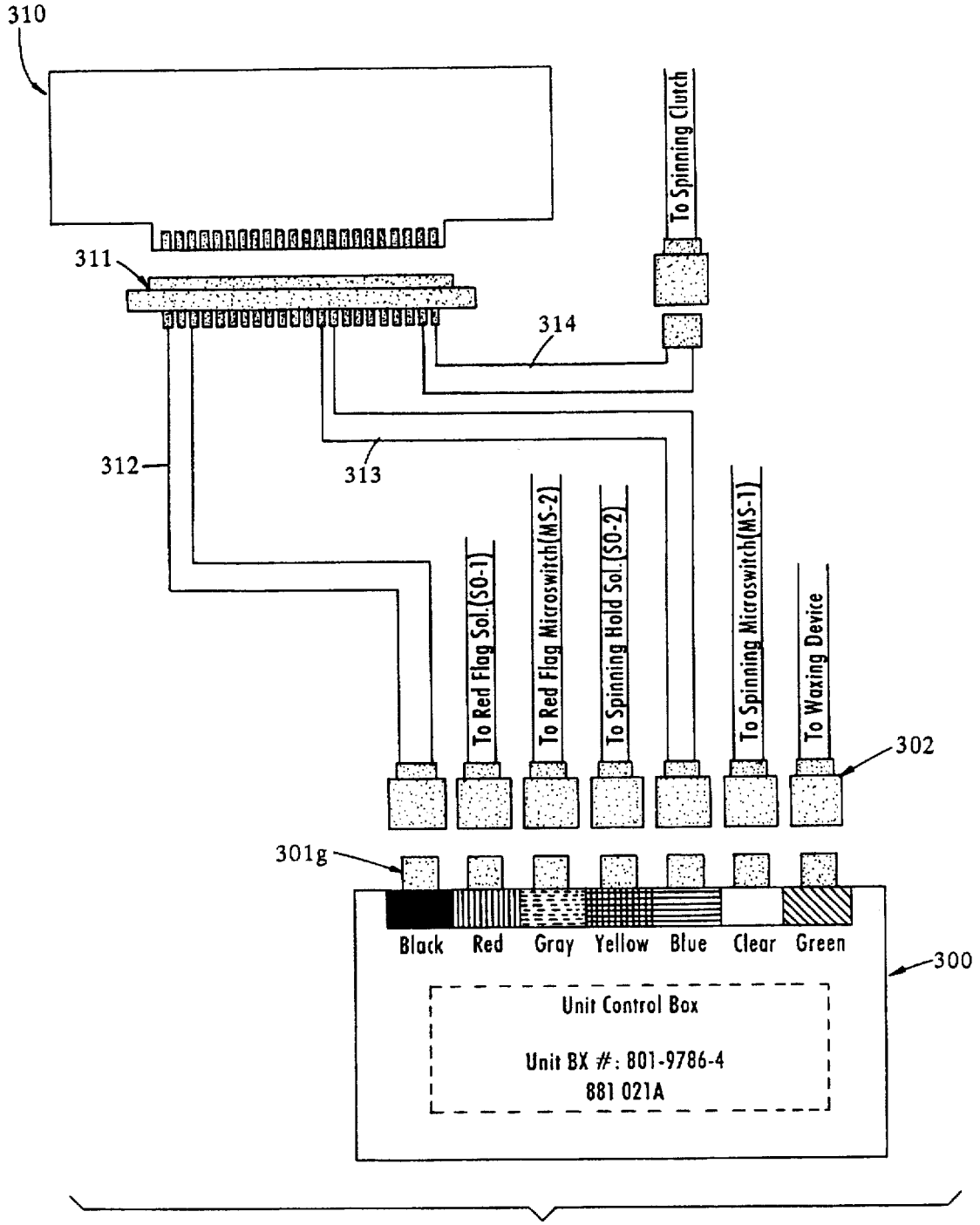
FIG. 16 shows the interfacing between the unit control box of FIG. 15 and the control circuit board 310 of FIG. 17.

FIG. 16 schematically shows the interfacing between the standard MJS unit control box 300 (with spare jack 301g added) and second circuit board 310. A pin connector 311 connected to the circuit board 310 has a first patch cord 312 extending therefrom to access the spare jack 301g on the unit control box 300. A second patch cord 313 extends from the pin connector 311 and accesses the spinning clutch jack 301c of the unit control box 300. A third patch cord 314 extends from the pin connector 311 and accesses the standard spinning clutch on the MJS. A relay ("Relay 3", FIG. 17) is provided on the circuit board 310 to allow standard control of the spinning clutch by the unit control box 300 or to allow the second circuit board 310, particularly the microprocessor chip 320, to seize control of the spinning clutch of the MJS in accordance with the present invention.

The spare jack 301g includes two pins (7A, 7B; FIG. 18B) for communicating, via patch cord 312, with two pin connections 322, 323 on the circuit board 310 shown in FIG. 17. The two pins in jack 301g are connected by wires to existing wiring in the MJS unit control box 300 as shown in FIG. 18B. The block diagram in FIGS. 18A and 18B are from circuit board #881021A included in the unit control box 300 of the MJS Model 801-9786-4.

Figure 17:
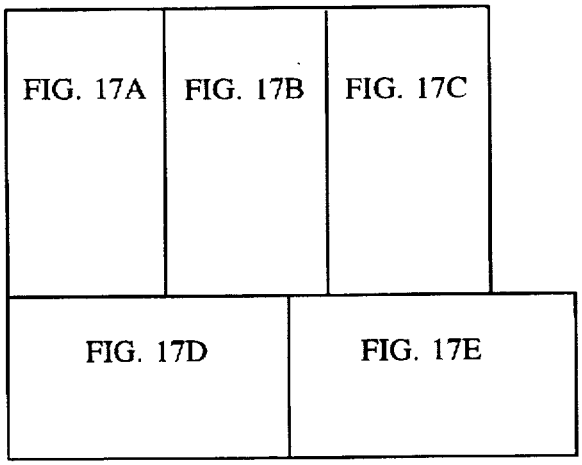
FIG. 17 broken up as FIGS. 17*a–e* is a schematic view showing a preferred control circuit 310 used in the present invention.
Figure 17A:
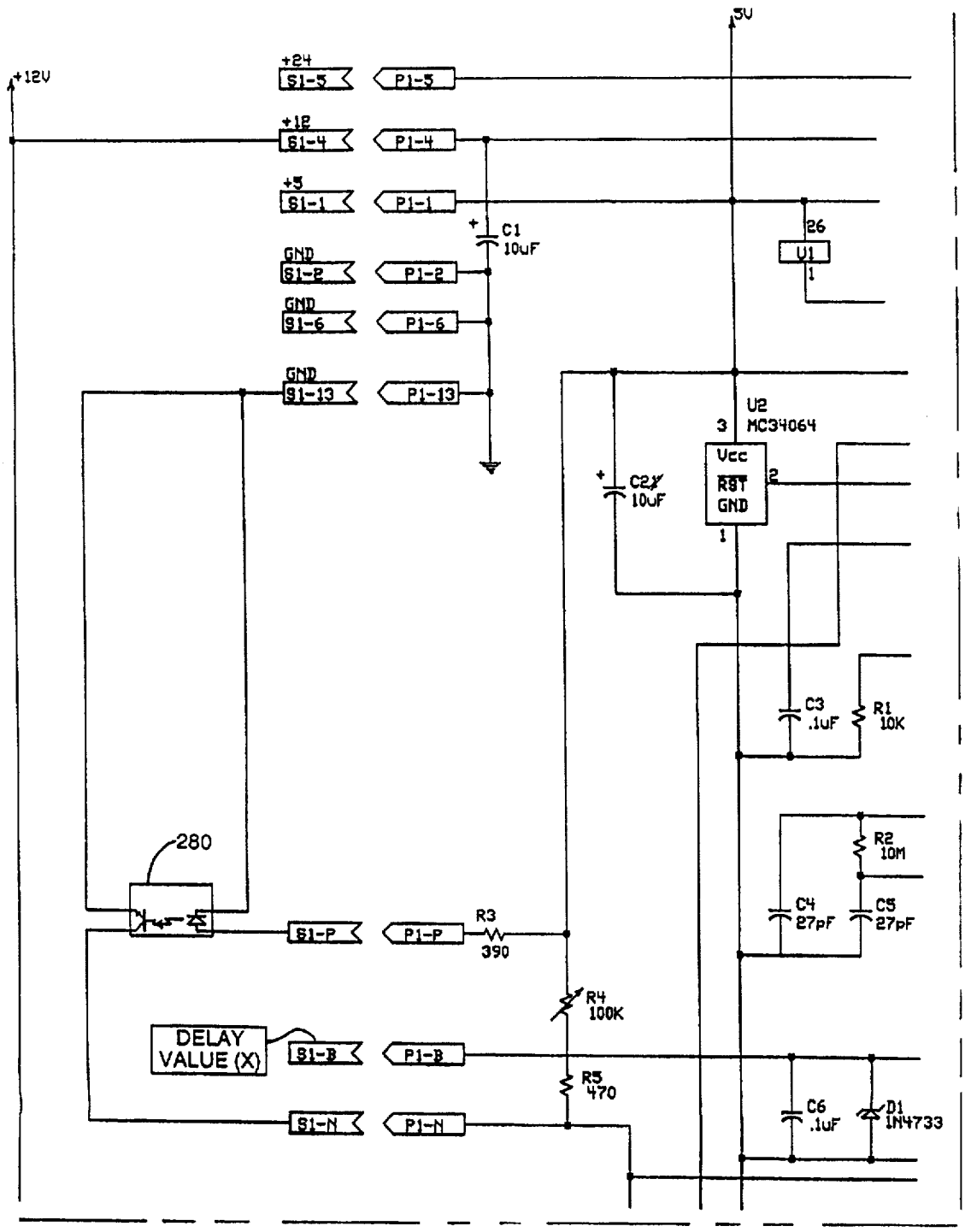
Figure 17B:
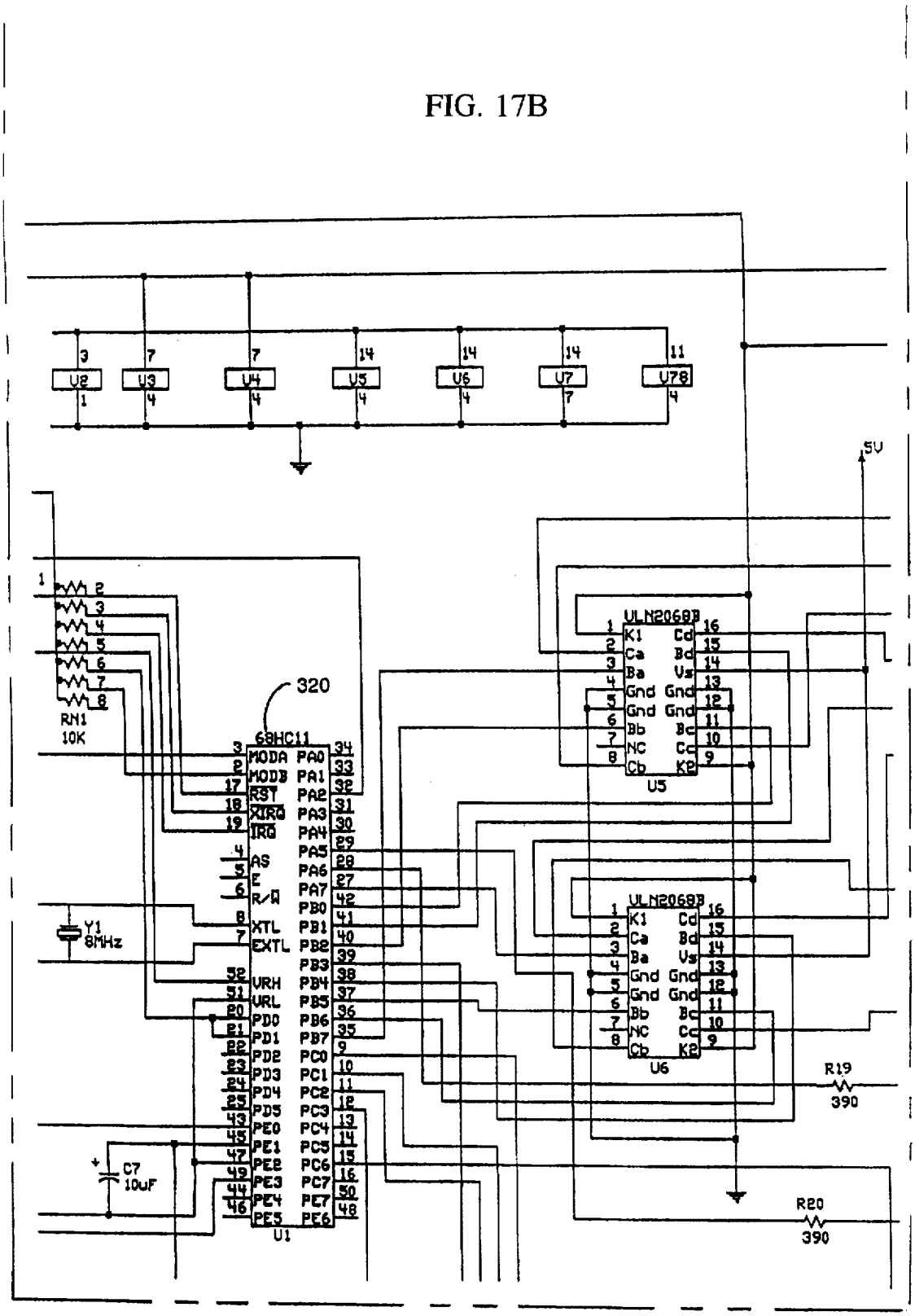
Figure 17C:
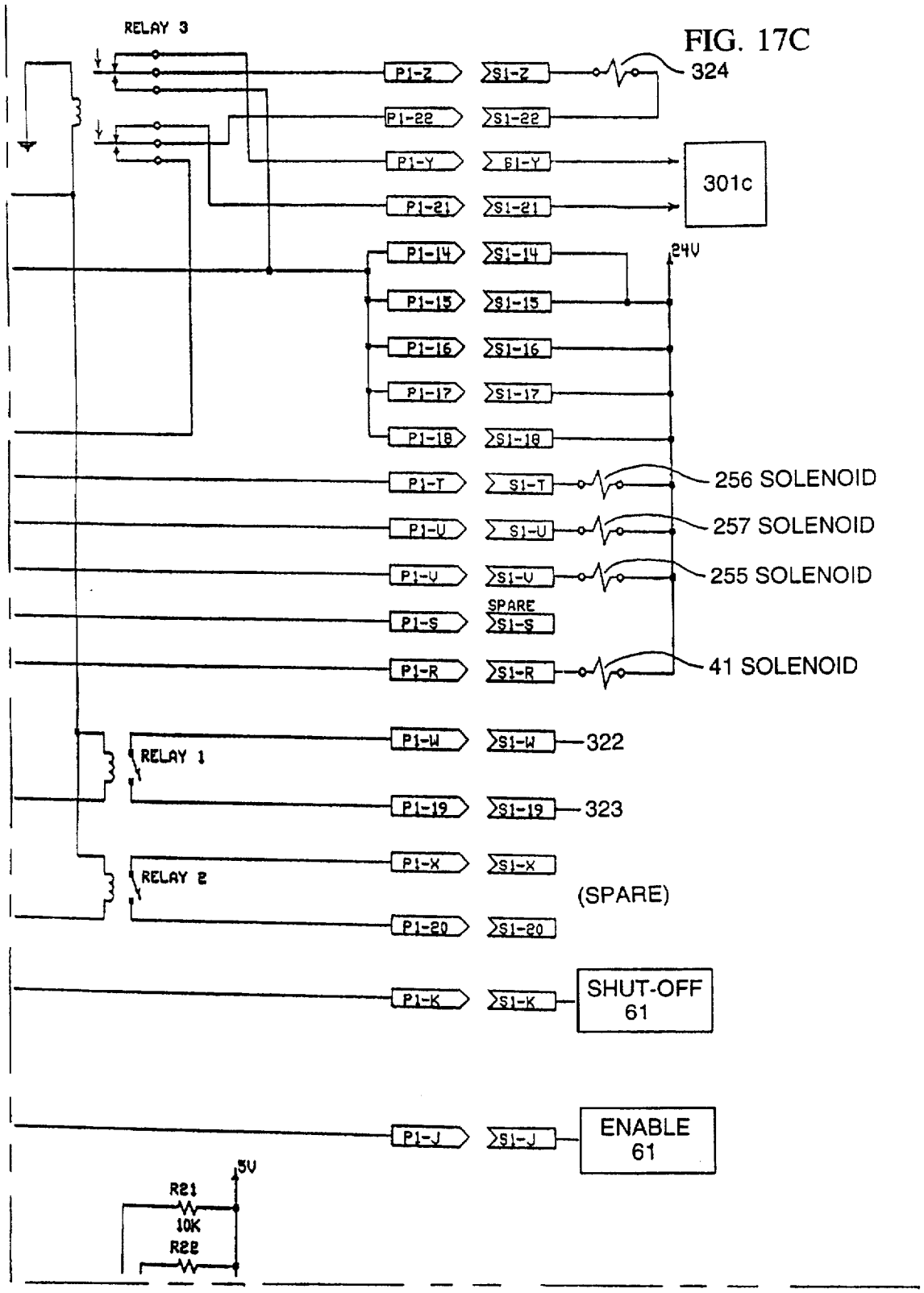
Figure 17D:
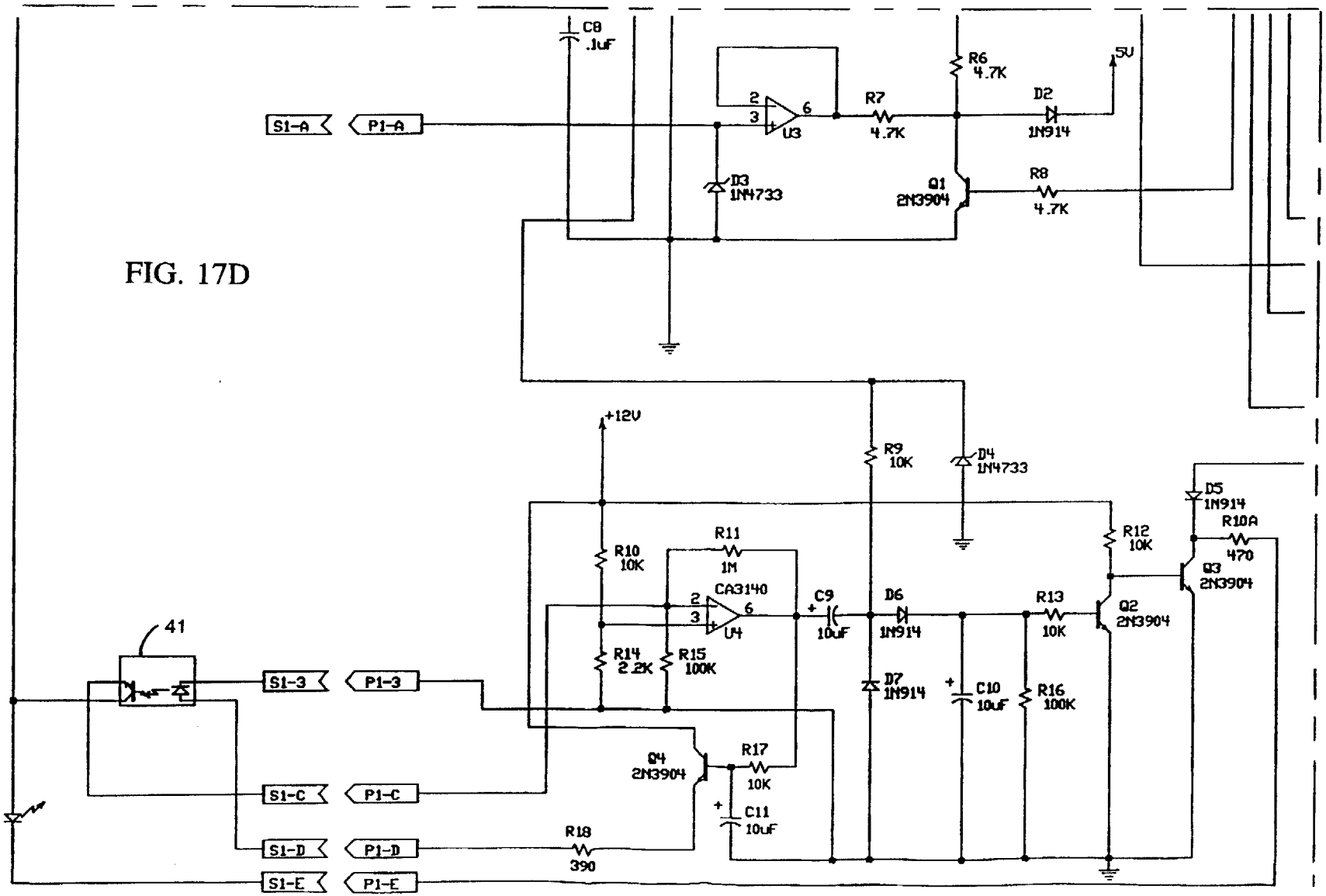
Figure 17E:
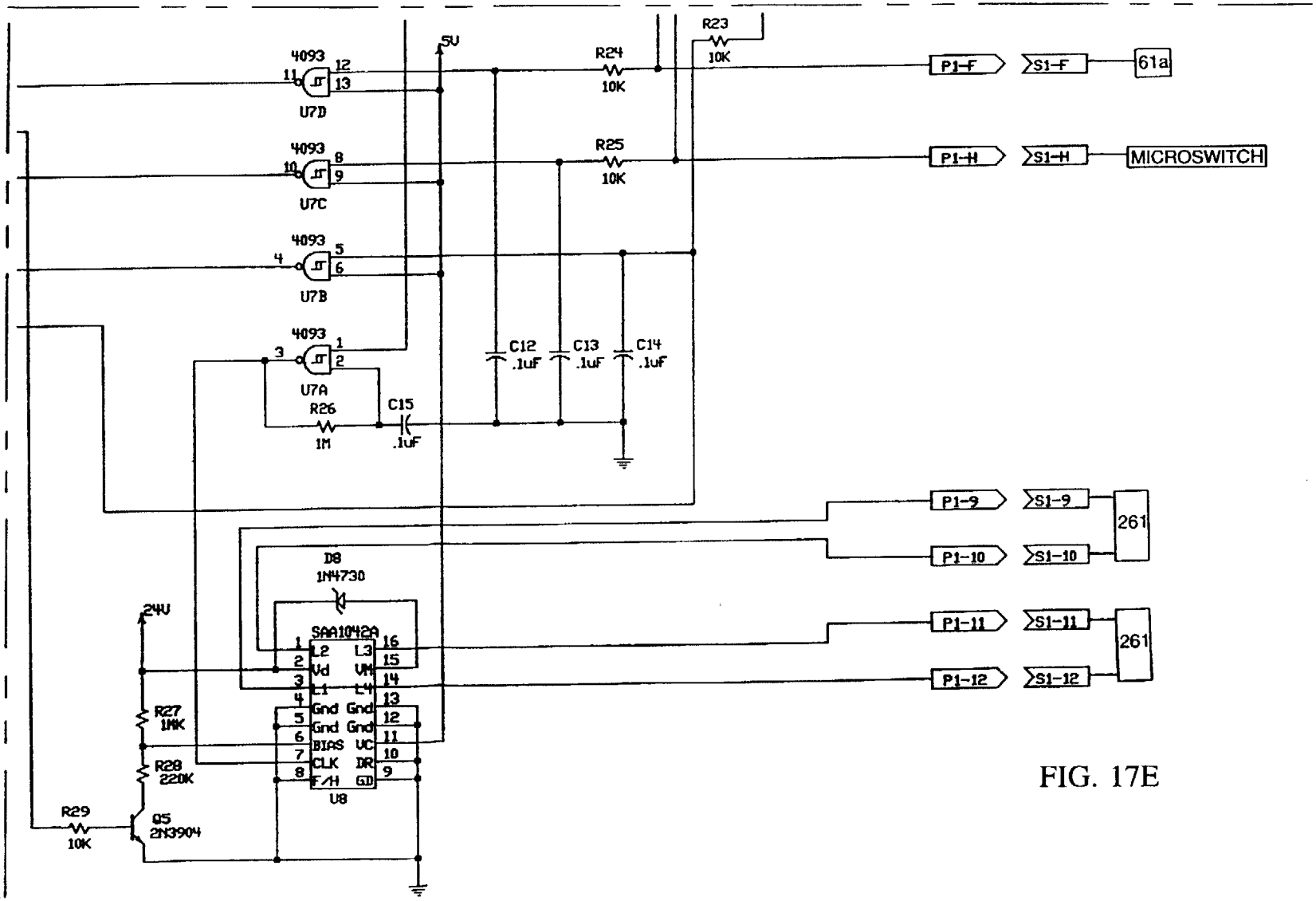
Figure 18B:
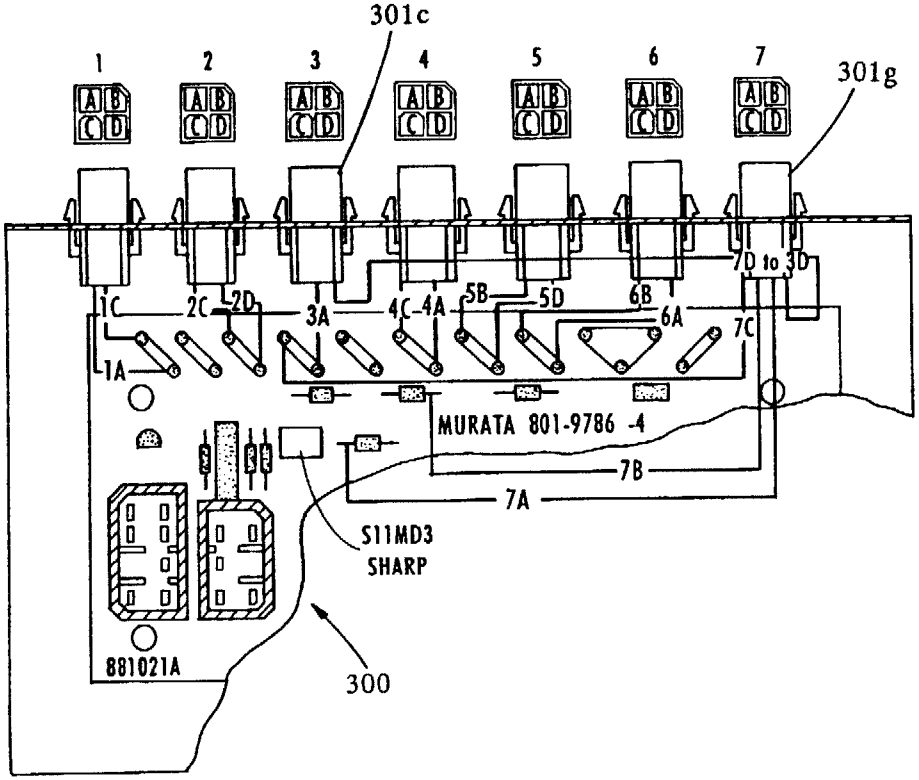
FIG. 18B shows how the unit control box is modified to interface with the control circuit board of FIG. 16.
Figure 18A:
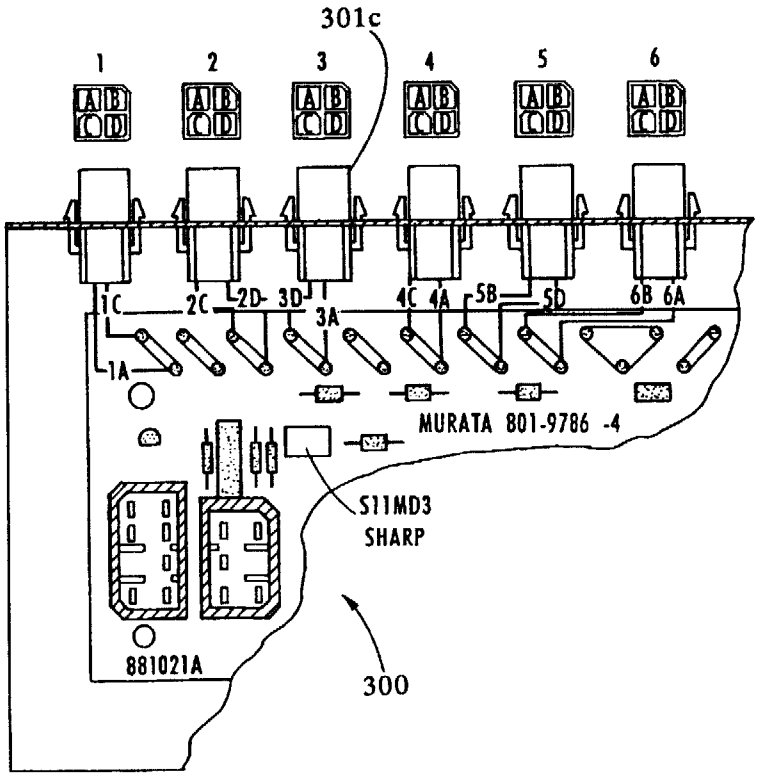
FIG. 18A is a cut-away partial schematic view of the circuitry contained in the unit control box.

In the block diagram of FIGS. 18A and 18B, plug numbers 1–6 correspond to the plugs color coded in FIG. 16 as green, clear, blue, yellow, gray and red, respectively (i.e., the order of plugs in FIG. 18 being opposite that shown in FIG. 17). Plug number 7 in FIG. 18B corresponds to the black color coded plug in FIG. 16. FIG. 18A corresponds to the standard unit control box on the Murata MJS, and FIG. 18B shows the same unit control box 300 modified to interface with the yarn feed system of the present invention.

Plug number 3, controls the spinning/sliver clutch of the MJS. In accordance with the present invention, that plug is removed and replaced with the plug extending from patch cord 313 shown in FIG. 16. FIG. 18B shows that the second wire 3D of the number 3 plug is connected to the D wire of the number 7 plug. The C wire of plug number 7 is connected to the terminal on the standard Murata circuit board to which the 3D wire of the number 3 plug previously was connected. The 7A and 7B wires of the number 7 plug are connected to the components labeled $D_9$ and $D_3$, respectively, on the standard Murata circuit board. As explained above, the 7A and 7B wires are connected to pins 322 and 323 shown in FIG. 17. The block diagram in FIG. 18B shows the extent to which the circuit board of the existing unit control box 300 on the Murata MJS is interfaced with circuit board 310 in accordance with the present invention.

The remaining pin-outs of the control circuit board 310 will be explained hereinbelow.

Operation

By way of example, the exemplary circuit diagram shown in FIG. 17 and the production of spandex core/synthetic blend wrap yarn will now be explained in the context of a Murata MJS Model 801-9786-4 modified to include the yarn feed system of the present invention (using the package drive assembly of FIGS. 4 and 5A, the sensor of FIG. 6, and the thread-up assembly of FIG. 12A.

FIGS. 19A-D show a detailed flow diagram of the operational control program stored in the microprocessor chip 320 on the second circuit board 310. The operation and control of the MJS as modified in accordance with the present invention will be explained below in the context of four sequences: Initial Thread-up; Automatic Threading; Breakage; and Shut-Down, all with reference to FIGS. 19A-D, respectively. Any operator-assisted steps or explanatory notes not part of the program are shown in dotted lines in FIGS. 19A-D.

Figure 19A:
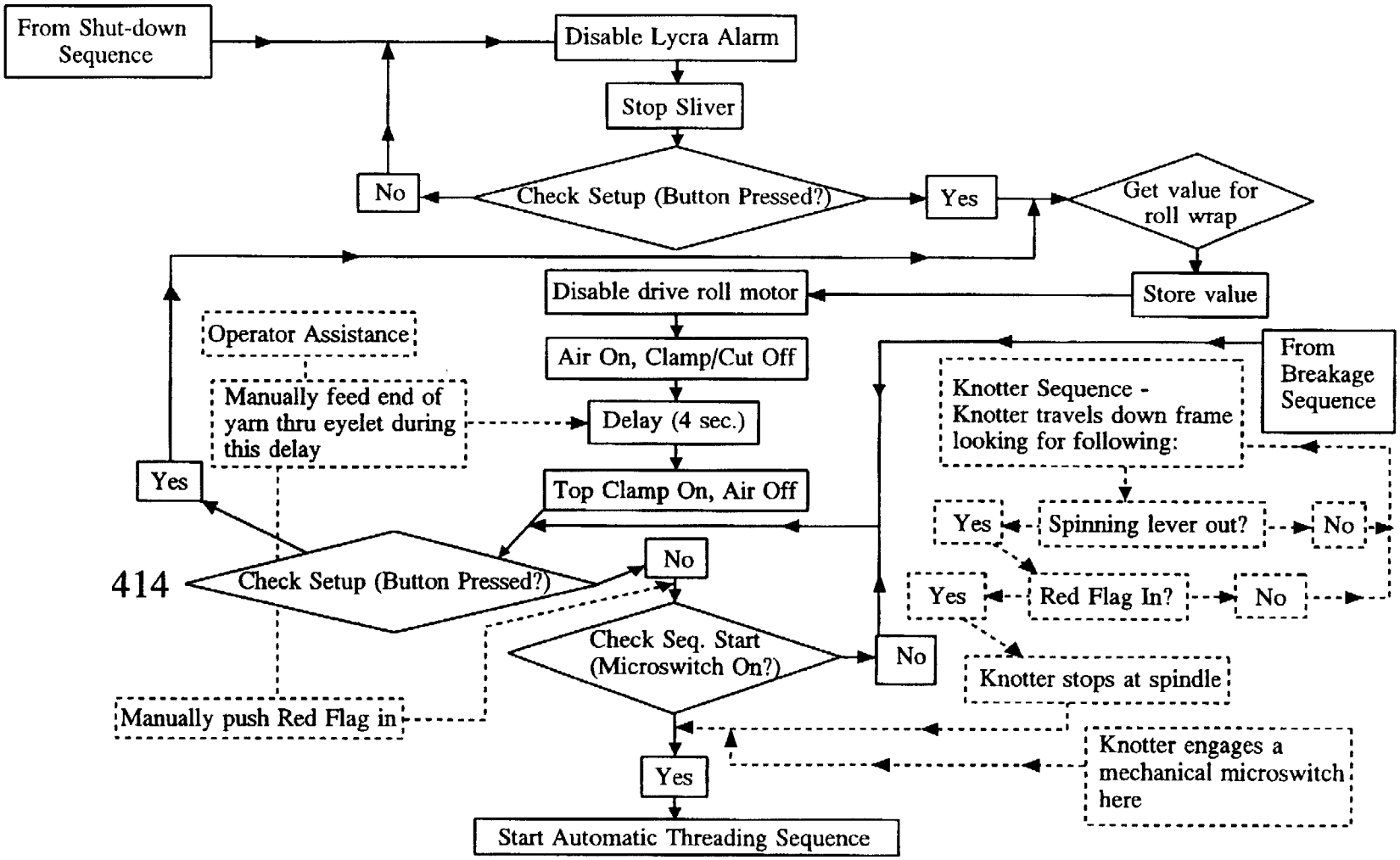
FIGS. 19A–19D are flow diagrams explaining the sequence for controlling the system of the present invention.

Initial Thread-up Sequence—FIG. 19A

During initial threading of a new spandex yarn package, or if the yarn breaks above the thread-up device 240, the package 50 is positioned on the package tube holder 56 and the outside peripheral surface of the package contacts the package drive roller 60. The package tube holder shaft 55 can be moved up and down through oblong slot 54 formed in front face 51a of mounting plate 51. The slide block 53 moves up and down in the slide block channel 52 to maintain the rotating axis of the package 50 parallel to the rotating axis of the package drive roller 60. As yarn is drawn off package 50, gravitational force and the biasing force of the coil spring 59 cause the package 50 to maintain constant contact with the drive roller 60.

During initial thread-up, as shown in FIG. 19A, the spandex yarn sensor 41 is disabled and the solenoid 324 of the spinning clutch is disengaged to stop the feed of sliver to the drafting assembly. A human operator then meters several inches of spandex yarn from the package 50 and presses the set-up button 61a (shown in FIG. 3) to initiate the Initial Thread-up Sequence. At this time the front roll wrap sensor 280 takes an initial reading from the upper surface of the upper front roll 224 and that reading is stored in the microprocessor chip 320.

The drive roll motor 61 is then disabled by removing the current supplied thereto. Since the drive roll motor is a so-called stepper motor, low levels of current can be applied thereto to prevent the shaft of the motor from rotating due to external rotational forces applied to the shaft. When current is not supplied to the motor, the shaft can be turned freely, and thus the human operator can rotate the spandex package accordingly.

Pressing the set-up button also causes the top clamp 245 and the lower clamp/cutter 246 to be released by operation of their respective solenoid valves provided in conduits 255 and 256, and also causes air to be supplied to the yarn delivery bore 242 of the thread-up device 240 by operation of the solenoid valve in conduit 257. There is then a delay of about 4 seconds during which time the human operator must manually feed the end of the spandex yarn into eyelet 242c of thread-up device 240.

After the 4 second delay, the top clamp 245 is activated and simultaneously the air supplied to the yarn delivery bore 242 is terminated. The microprocessor then again determines whether the set-up button 61a is pressed. If it is pressed, this means that the human operator was unable to successfully manually feed the end of the spandex yarn through the thread-up device 240 and the set-up sequence begins again as shown in FIG. 19A.

If the set-up button is not pressed, but instead the human operator was successful in feeding the yarn through the thread-up device 240 and pressed the red flag (a standard switching mechanism in the Murata MJS) to signal the knotter that the spindle is ready for automatic threading (discussed below), the microprocessor then checks whether the microswitch (MS, FIG. 3) on the spindle has been activated by the knotter. The knotter sequence (standard on the MJS) is also shown in FIG. 19A. If the microswitch has not been activated, the computer program loops or recycles as shown in FIG. 19A until the microswitch is activated by the knotter. In certain instances where the operator is manually doffing a full package of core/wrap yarn, the mechanical microswitch may be activated manually by the operator.

At this stage, top clamp 245 of thread-up device 240 is holding the spandex yarn end in yarn delivery bore 242, so that the spandex yarn can be introduced into the drafting assembly during the Automatic Threading Sequence. The spandex yarn may or may not be visibly extending from the exit surface of the thread-up device 240. The human operator should index the creel package in reverse to remove any slack from the spandex yarn end.

Figure 19B:
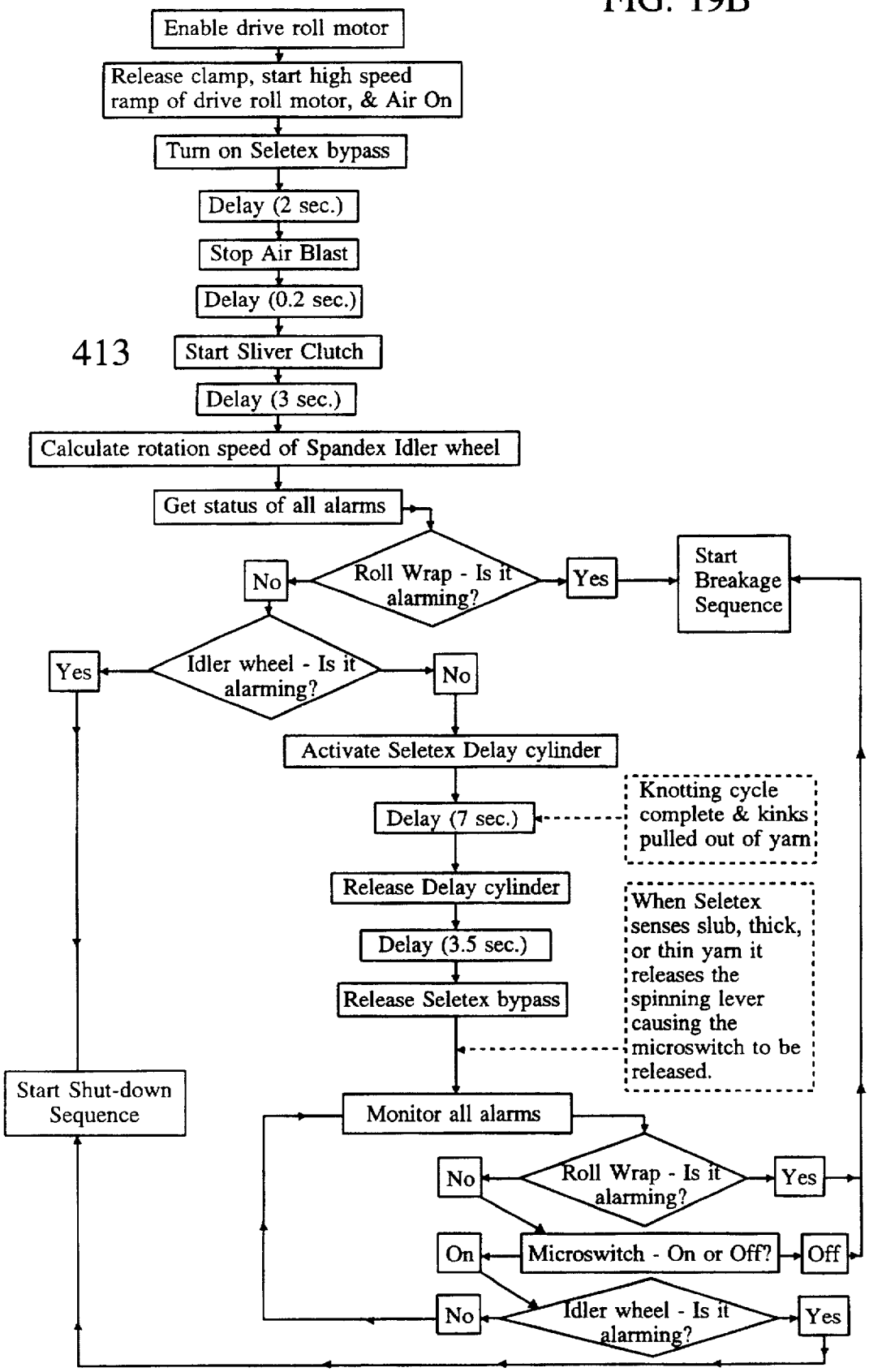

Automatic Threading Sequence—FIG. 19B

Once the knotter is situated at the spindle and activates the microswitch on the spindle, the Automatic Threading Sequence begins. The microprocessor enables the drive roll motor (via "Enable 61" in FIG. 17) by providing enough current thereto actively to prevent free rotation of the motor shaft, but insufficient current to actually rotate the motor shaft. Then, at the same time, the upper clamp 245 is released (by operation of the solenoid valve in conduit 255), ramping current is supplied to the drive roll motor 61, and air is supplied to yarn delivery bore 242 (by operation of the solenoid valve in conduit 257) via the third bore 251 and air supply conduit 257 provided in conduit block 254.

The microprocessor then turns on the electronic yarn clearer bypass, which is simply an electronic relay switch (Relay 1 in FIG. 17) that prevents output from the yarn clearer sensor 3 (e.g., a Seletex® sensor) from being detected by the microprocessor. Allowing the yarn clearer sensor 3 to be active during initial production of the core/wrap yarn could cause a voltage spike in the yarn clearer due to the increased size of the yarn in a relaxed state due to lack of tension. It could take the yarn clearer up to 15 seconds to recover from the voltage spike, during which time the spindle would not function.

After about a 2 second delay, the air supply to the thread delivery bore 242 is terminated. At this time, since the front rollers (and apron rollers) of the drafting assembly are not disabled by the spinning clutch, the spandex yarn has been fed through the air jet spinning nozzle 12. After the air supply to the thread delivery bore 242 is terminated, there is a 0.2 second delay to make sure all air is out of the thread-up device 240, and then the solenoid 324 of the spinning (sliver) clutch is engaged to feed sliver to nozzle 12. By this time the knotter has positioned the suction hose 24 at the exit of the air jet spinning nozzle 12, and drafting assembly 11, in conjunction with suction hose 24 and the spandex yarn already fed through the air jet spinning nozzle, assist in feeding the drafted sliver synthetic blend yarn through the air jet spinning nozzle 12. The drafted synthetic blend fibers are wrapped around the spandex yarn core in the air jet spinning nozzle 12.

After the sliver clutch is engaged, as shown by box 413 in FIG. 19B, there is a 3 second delay, and then the microprocessor calculates the rotation speed of the idler wheel 106 in the spandex yarn sensor 41 using signals produced by the photomicrosensor, as explained above. This initial rotational speed of the idler wheel in the spandex yarn sensor is used as a threshold value against which future rotational speeds will be compared to detect breakage of the spandex yarn above the thread-up device 240.

The microprocessor then determines whether the front roll wrap sensor 280 is experiencing an alarm condition (i.e., whether spandex and/or synthetic blend yarn are wrapping around the front roll 224 of the drafting assembly). If so, then the microprocessor begins the Breakage Sequence as explained later herein.

If the roll wrap sensor is not experiencing an alarm condition, the microprocessor then determines whether the spandex yarn sensor 41 is experiencing an alarm condition. That is, the microprocessor determines whether there is breakage above the thread-up device 240. If no alarm condition is sensed in the spandex yarn sensor, the microprocessor then proceeds to activate the yarn clearer delay cylinder 43 (by operation of solenoid 43 shown in FIG. 17). As explained above, the delay cylinder 43 is a solenoid activated mechanical plunger which extends outwardly from the front of the spindle to push the core/wrap yarn in and out of yarn clearer sensor 3. Delay cylinder 43 prevents the initially produced core/wrap yarn from entering the yarn clearer sensor head, because the quality of this yarn is not yet acceptable. An erroneous quality reading would result if the initial core/wrap yarn was detected by the yarn clearer sensor 3.

After activating the yarn clearer delay cylinder 43, there is then about a 7 second delay during which the knotting cycle is completed and all kinks are pulled out of the core/wrap yarn product being produced by the machine. That is, as in the conventional MJS machine, the suction hose 24 of the knotter 7, in conjunction with the suction pipe 25 of the splicer 27, tie the core/wrap yarn exiting the nozzle to the core/wrap yarn already wound on the take-up roll 22. The clearer delay cylinder 43 is then retracted so that the core/wrap yarn is allowed to pass through the head of the yarn clearer sensor 3, and then, after a 3.5 second delay, the yarn clearer electronic bypass is released (by operation of Relay 1). At this time the modified MJS is now producing high quality core/wrap yarn and the microprocessor now simply waits until an alarm condition is detected by one (or more) of the spandex yarn sensor, front roll wrap sensor or by monitoring the microswitch (MS).

Figure 19C:
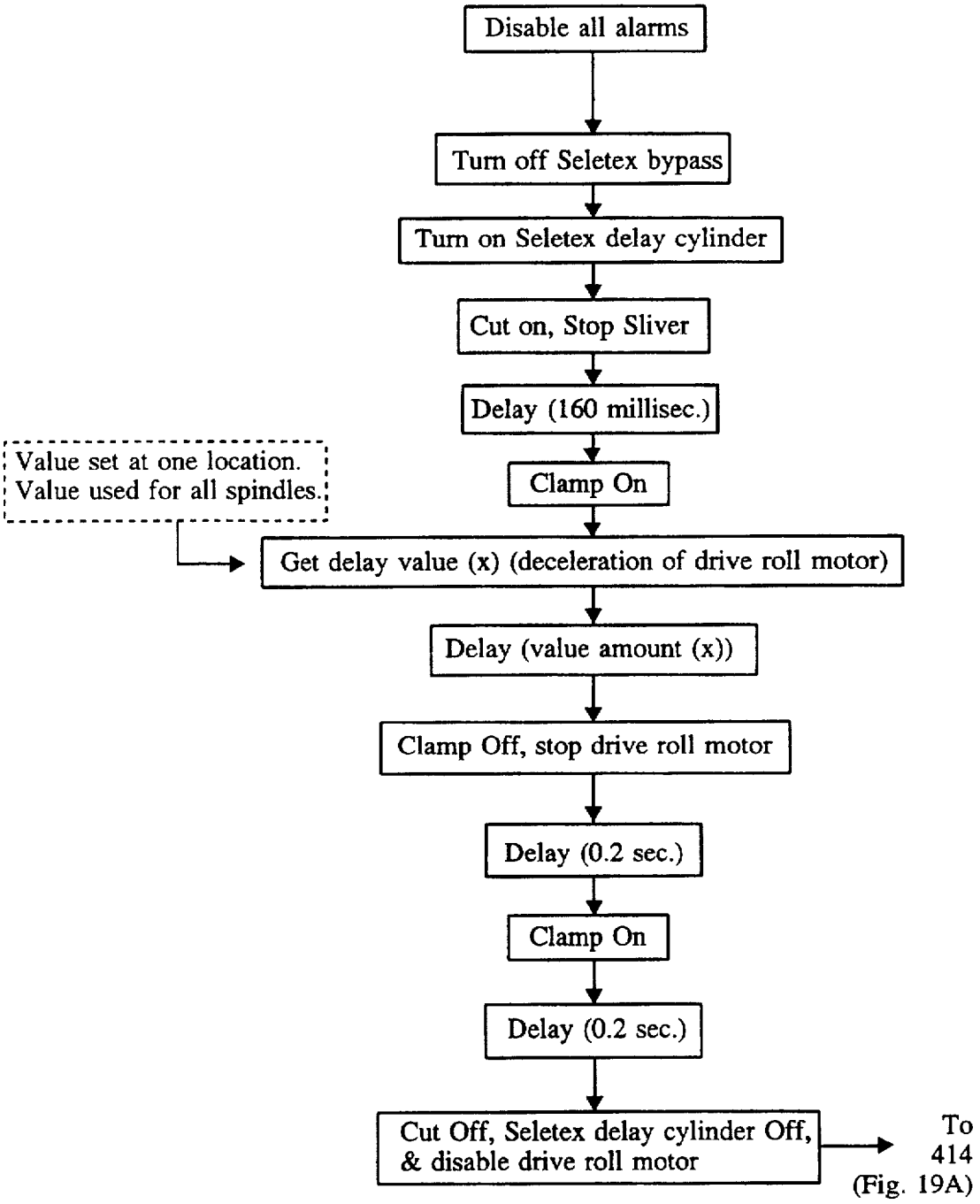

Breakage Sequence—FIG. 19C

If spandex and/or synthetic blend yarn begins to wrap around the front roll 224 of the drafting assembly, the front roll sensor 280 sends an alarm signal to the microprocessor. The microprocessor then begins the Breakage Sequence shown in FIG. 19C. Likewise, if the yarn clear sensor 3 detects excessively slubbed, thick, or thin core/wrap yarn, it releases the spinning lever (standard on MJS), which in turn causes the microswitch (MS) to be released. The microprocessor would also begin the Breakage Sequence at this point.

FIG. 19C shows that the Breakage Sequence begins by disabling all alarms, turning off the electronic yarn clearer sensor (e.g., a Seletex® sensor) bypass, and activating the clearer delay cylinder 43. Then the lower clamp/cutter 246 is activated to cut the supply of spandex yarn to the drafting assembly, and at the same time the sliver clutch is disengaged to stop the flow of sliver to the drafting assembly. Continued rotation of the front rollers 224 breaks the spandex yarn below the lower clamp/cutter 246 and conveys any remnant sliver out of the drafting assembly. After a 160 millisecond delay, the upper clamp 245 is activated and a delay value (X) (FIG. 17) is retrieved from memory to determine the deceleration ramp or rate of deceleration of the drive roller motor 61. The delay value (X) is programmed by the operator based on how much draw (extension) is desired to be maintained in the spandex yarn between the spandex package 50 and the thread-up device 240. The amount of draw produced by the rollers in the drafting assembly of the MJS is communicated to the microprocessor via the "Draw" pin-out shown in FIG. 17. The delay value (X) is communicated to the drive roller motor, which begins deceleration. The upper clamp 245 is then deactivated and the driving current supplied to the drive roll motor is terminated (via "Enable 61", FIG. 17). Again, a nominal current is supplied to the drive roll motor to prevent free rotation of the spandex package 50.

After the upper clamp 245 is deactivated and the drive roll motor is stopped, there is a 0.2 second delay to allow the creel package to index to release tension in the spandex 44 between the activated lower clamp/cutter 246 and the package 50, and then the upper clamp 245 is again activated to hold the spandex in place. After another 0.2 second delay, the lower clamp/cutter 246 is deactivated, the yarn clearer delay cylinder 43 is turned off, and the drive roll motor 61 is disabled, all occurring simultaneously, as shown in FIG. 19C. The program then proceeds to the "check set-up" command as shown by box 414 in FIG. 19A. The machine is now again ready to start the Automatic Threading Sequence.

Figure 19D:
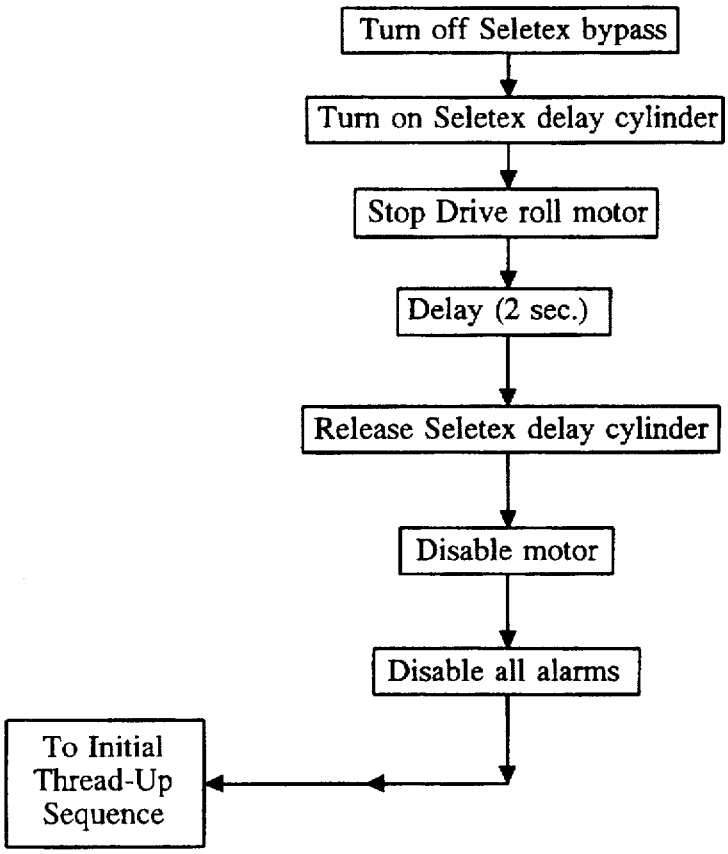

Shutdown Sequence—FIG. 19D

If the microprocessor does not detect any alarm in the front roll sensor 280, it then determines whether the microswitch is off due to an abnormal condition detected by the yarn clearer sensor 3 (discussed above). If the microswitch is off, then the microprocessor accesses the Breakage Sequence as explained above. If the microswitch is on, the microprocessor then determines whether there is an alarm condition in the spandex yarn sensor 41. If no alarm condition exists, the microprocessor simply continues looping or cycling in the monitoring loop as shown in FIG. 19B. If there is an alarm condition in the spandex yarn sensor 41, this means that the spandex yarn has broken above the thread-up device 240. The microprocessor will then proceed to the Shutdown Sequence of FIG. 19D and shut off the electronic yarn clearer sensor bypass, activate the yarn clearer delay cylinder (to push the core/wrap yarn out of the yarn clearer sensor head to avoid an erroneous quality reading), and immediately stop the drive roll motor 61. After about a 2 second delay, the yarn clearer delay cylinder is released, the drive roll motor is disabled (i.e., all current to the motor is terminated via the "shut-off 61"pin-out shown in FIG. 17), and all alarms are disabled.

After the human operator clears any debris from the drafting assembly, the system is now ready to proceed to the Initial Thread-up Sequence explained earlier herein.

The Core/Wrap Yarn

Prior to the present invention, there was no commercially viable system for producing elastomeric core/wrap yarn using air jet spinning techniques. The system of the present invention produces a superior quality elastomeric core/wrap yarn using air jet spinning techniques.

Figure 20:
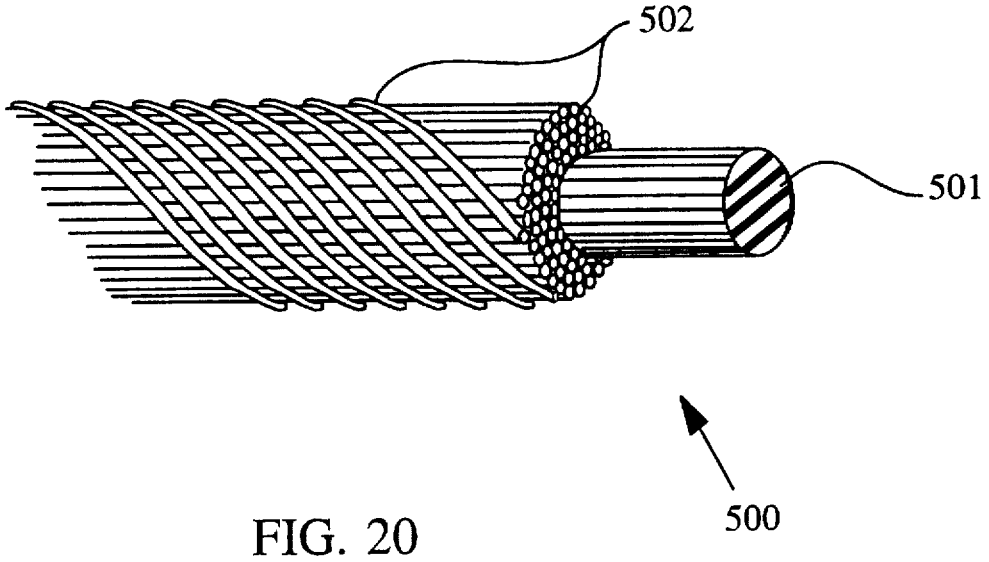
FIG. 20 is a partially schematic, partially cut-away illustration of the elastomeric core/staple fiber wrap yarn according to the present invention.

FIG. 20 is a partially schematic, partially cut-away illustration of the core/wrap yarn 500 of the present invention. The elastomeric core yarn 501 typically is a coalesced multifilament spandex yarn such as that available from DuPont under the trademark Lycra®, although it may be a single filament or multifilament highly elastic yarn, as desired. The elastomeric core yarn can be white or clear, depending upon the desired end use of the core/wrap yarn. The wrap 502 comprises staple fibers of synthetic or synthetic-cotton blend materials.

This core/wrap yarn is distinguishable from elastomeric core/wrap yarns formed by former methods such as ring spinning, in that the core/wrap yarn of the present invention includes wrapper fibers twisted around the exterior of the bundle of wrapper fibers which encase the core, whereas ring spun core/wrap yarns do not include such twisted outer wrapper fibers. Additionally, there is no residual twist in the present core/wrap yarn, as is present in ring spun core/wrap yarns.

The system of the present invention all but renders obsolete the prior machines for making elastomeric core/wrap yarns, in that the present system allows a 60 spindle MJS machine to perform the work of 600–900 roving fed ring spinning machines. Additionally, the core/wrap yarn of the present invention is extraordinarily free of defects, such as splicing knots due to breaks, over lengths of at least 15,000 yards. In fact, entire doff packages of about 32,000 yards of defect-free core/wrap yarn have been produced on a regular basis.

While the present invention has been described above in detail, it will be appreciated by those skilled in the art that various changes and modifications could be made thereto without departing from the scope and spirit thereof as defined in the attached claims. For example, the invention has been explained in the context of a Murata MJS machine, but could be adapted for use on other jet spinning machines.

What is claimed is:

1. A substantially twistless core/wrapped elastic yarn product, comprising:

a unitary filament elastomeric core yarn; and staple fibers in a substantially untwisted non-yarn form provided contiguously around said elastomeric core, wherein an inner portion of said staple fibers extends in substantially the same direction as said elastomeric core, and an outer wrapper portion of said staple fibers is generally helically wound around and holds said inner portion of said staple fibers on said elastomeric core.

2. The yarn product of claim 1, wherein said elastomeric core is a spandex yarn.

3. The yarn product of claim 1, wherein said staple fibers comprise synthetic staple fibers.

4. The yarn product of claim 1, wherein said staple fibers comprise natural staple fibers.

5. The yarn product of claim 1, wherein said staple fibers comprises a blend of synthetic staple fibers and natural staple fibers.

6. The yarn product of claim 1, wherein said yarn product has a length of at least 15,000 yards without the presence of splicing knot defects.

7. The yarn product of claim 6, wherein said yarn product has a splicing knot defect-free length of at least 32,000 yards.

8. A jet spun, substantially twistless core/wrapped elastic yarn product, comprising:

a unitary filament elastic core yarn; and staple fibers in a substantially untwisted non-yarn form provided configuously around said elastomeric core, wherein an inner portion of said staple fibers extends in substantially the same direction as said elastomeric core, and an outer wrapper portion of said staple fibers is generally helically wound around and holds said inner portion of said staple fibers on said elastomeric core;

wherein said yarn product has a length of at least 15,000 yards without the presence of splicing knot defects.

9. The yarn product of claim 8, wherein said elastomeric core is a spandex yarn.

10. The yarn product of claim 8, wherein said staple fibers comprise synthetic staple fibers.

11. The yarn product of claim 8, wherein said staple fibers comprise natural staple fibers.

12. The yarn product of claim 8, wherein said staple fibers comprise a blend of synthetic staple fibers and natural staple fibers.

13. The yarn product of claim 8, wherein said yarn product has a splicing knot defect-free length of at least 32,000 yards.

14. A jet spun, substantially twistless yarn product, comprising:

a unitary filament elastomeric core yarn; and staple fibers in a substantially untwisted non-yarn form provided contiguously around said elastomeric core, an inner portion of said staple fibers extending in substantially the same direction as said elastomeric core, and an outer portion of said staple fibers extending generally helically around said inner portion of said staple fibers to hold said inner portion of staple fibers on said elastomeric core;

wherein said yarn product has a length of at least 15,000 yards without the presence of splicing knot defects.

15. The yarn product of claim 14, wherein said elastomeric core is a spandex yarn.

16. The yarn product of claim 14, wherein said staple fibers comprise synthetic staple fibers.

17. The yarn product of claim 14, wherein said staple fibers comprise natural staple fibers.

18. The yarn product of claim 14, wherein said staple fibers comprise a blend of synthetic staple fibers and natural staple fibers.

19. The yarn product of claim 14, wherein said yarn product has a splicing knot defect-free length of at least 32,000 yards.

* * * * *